US006022659A

United States Patent [19]

Kanbayashi et al.

[11] Patent Number: 6,022,659

[45] Date of Patent: Feb. 8, 2000

[54] YELLOW TONER FOR DEVELOPING ELECTROSTATIC IMAGES

[75] Inventors: Makoto Kanbayashi, Shizuoka-ken; Masaaki Taya, Mishima; Wakashi Iida, Numazu; Tetsuya Ida, Mishima, all of Japan

[73] Assignee: Canon Kabushiki Kaisha, Tokyo, Japan

[21] Appl. No.: 09/031,892

[22] Filed: Feb. 27, 1998

[30] Foreign Application Priority Data

Feb. 28, 1997 [JP] Japan ..... 9-045387
Dec. 17, 1997 [JP] Japan ..... 9-347433

[51] Int. Cl.[7] ..... G03G 9/09

[52] U.S. Cl. ..... 430/106; 430/137

[58] Field of Search ..... 430/106, 111, 430/137

[56] References Cited

U.S. PATENT DOCUMENTS

| | | | |
|---|---|---|---|
| 5,578,407 | 11/1996 | Kasuya et al. | 430/111 |
| 5,578,408 | 11/1996 | Kohtaki et al. | 430/106.6 |
| 5,843,605 | 12/1998 | Anno et al. | 430/111 |

FOREIGN PATENT DOCUMENTS

| | | |
|---|---|---|
| 0662638 | 7/1995 | European Pat. Off. . |
| 0705886 | 9/1995 | European Pat. Off. . |
| 0743563 | 11/1996 | European Pat. Off. . |
| 47-12334 | 6/1972 | Japan . |
| 50-62442 | 5/1975 | Japan . |
| 51-144625 | 12/1976 | Japan . |
| 55-60960 | 5/1980 | Japan . |
| 57-037353 | 3/1982 | Japan . |
| 57-109825 | 7/1982 | Japan . |
| 57-208559 | 12/1982 | Japan . |
| 58-011953 | 1/1983 | Japan . |
| 58-014144 | 1/1983 | Japan . |
| 59-007960 | 1/1984 | Japan . |
| 59-029256 | 2/1984 | Japan . |
| 59-057256 | 4/1984 | Japan . |
| 60-123852 | 7/1985 | Japan . |
| 61-091666 | 5/1986 | Japan . |
| 61-117565 | 6/1986 | Japan . |
| 61-156054 | 7/1986 | Japan . |
| 62-078568 | 4/1987 | Japan . |
| 62-078569 | 4/1987 | Japan . |
| 2-087160 | 3/1990 | Japan . |
| 2-207273 | 8/1990 | Japan . |
| 2-207274 | 8/1990 | Japan . |
| 2-208662 | 8/1990 | Japan . |
| 2-37949 | 8/1990 | Japan . |
| 4-039671 | 2/1992 | Japan . |
| 4-039672 | 2/1992 | Japan . |
| 4-242752 | 8/1992 | Japan . |
| 6-230607 | 8/1994 | Japan . |
| 6-266163 | 9/1994 | Japan . |
| 8-036275 | 2/1996 | Japan . |
| 8-209017 | 8/1996 | Japan . |
| 8-262799 | 10/1996 | Japan . |

OTHER PUBLICATIONS

Patent Abstracts, Japan, vol. 18, No. 674 (p. 1846) Dec. 1994 for JP 06–266163.

*Primary Examiner*—John Goodrow
*Attorney, Agent, or Firm*—Fitzpatrick, Cella, Harper & Scinto

[57] ABSTRACT

A yellow toner for developing electrostatic images is formed of yellow toner particles containing a binder resin and a yellow colorant. The yellow toner has a storage modulus $G'_{180}$ at 180° C. and a minimum storage modulus $G'_{min(120\text{-}170)}$ in a temperature range of 120–170° C. giving a ratio $[G'_{180}/G'_{min(120\text{-}170)}]$ of 2.0–8.0. The binder resin comprises a polyester resin having a glass transition temperature of 50–65° C. and an acid value of 2.0–25.0 mgKOH/g. The yellow toner is a compound represented by Formula (1) below:

Formula (1):

The primary particles of the yellow colorant exhibit a length/breadth ratio of at most 1.5. The yellow colorant is dispersed in the toner particles as independent particles (including primary particles and secondary particles) providing a number-average particle size of 0.1–0.7 μm. The yellow toner is provided with improved fixability and anti-offset property as well as good color toner performances.

31 Claims, 4 Drawing Sheets

YELLOW TONER FOR DEVELOPING ELECTROSTATIC IMAGES

FIELD OF THE INVENTION AND RELATED ART

The present invention relates to a yellow toner for developing electrostatic images in electrophotography, electrostatic recording and electrostatic printing. Particularly, the present invention relates to a yellow toner for forming full-color images or multi-color images, capable of exhibiting a broad color reproducibility in full-color image formation, excellent anti-offset characteristic and low-temperature fixability, and further excellent environmental stability and continuous image forming performances.

In recent years, much attention has been called to full-color copying machines and full-color printers. Particularly, a full-color copying machine or a full-color printer for developing digital electrostatic images has demanded great attention and is widely used on the market.

Full-color image formation according to full-color electrophotography is generally effected by color reproduction with color toners of three primary colors of yellow, magenta and cyan or four color toners further including a black toner.

More specifically, in a full-color image forming method for example, light from an original is caused to pass through a color separation filter having a color complementary to that of a toner, and laser light based on the light having passed the filter is caused to illuminate a photoconductor layer to form an electrostatic latent image with an assemblage of dots thereon. The latent image is then developed and the resultant toner image is transferred onto a support material. The above-mentioned steps are repeated while effecting registration to form superposed color toner images, which are usually transferred onto a transfer-receiving material, such as paper, and then fixed to provide a final full-color image, e.g., in a hot-pressure fixation step.

In such a full-color electrophotography process wherein development is performed in plural times, and a plurality of toner layers of different colors transferred onto a transfer-receiving material via or without via an intermediate transfer member are fixed under application of heat and pressure, the fixing performances of the respective color toners are important factors.

A fixed color toner is required to show appropriate degrees of luster and gloss by suppressing random reflection by toner particles at the maximum.

It is further preferred that a toner forming an upper color toner layer has a sufficient transparency not to hinder the hue of a lower layer-forming different color toner, thus providing a broad color reproducibility.

Our research and development group has proposed color toners comprising novel combinations of binder resins and colorants in Japanese Laid-Open Patent Application (JP-A) 50-62442, JP-A 51-144625 and JP-A 59-57256.

These color toners have a substantial degree of sharp-melting characteristic and can be fixed in a nearly completely melted state to deform the toner particles during the heat and pressure fixation in combination with a silicone rubber roller capable of silicone oil application, thus providing preferable gloss and color reproducibility.

In these toners, as the viscoelasticity of a binder resin for providing a good toner fixation performance, a viscosity factor has been thought more of than an elasticity term.

These toners cause a sharp decrease in melt-viscosity under application of heat and pressure to provide fixed images with excellent gloss.

However, such a viscosity term-weighted design of binder resin naturally results in a lower molecular cohesion of the binder resin at the time of heat melting, so that the toner attachment onto the hot roller is liable to be increased when passing through the fixing apparatus, and high temperature offset phenomenon is liable to occur.

In order to solve or alleviate the above-mentioned difficulties, it has been proposed to incorporate into toner particles a releasability-enhancing component, such as low-molecular weight polyethylene wax or polypropylene wax, or higher fatty acid, in JP-A 55-60960, JP-A 57-208559, JP-A 58-11953, JP-A 58-14144 and JP-A 60-123852. This is effective in offset prevention but, on the other hand, the inclusion of much release agent for exhibiting sufficient offset prevention performance is liable to result in difficulties, such that the transparency of a color toner as required in providing OHP images is lowered, the chargeability of the color toner becomes unstable, and the continuous image forming performance of the color toner is lowered.

JP-A 47-12334, JP-A 57-37353 and JP-A 57-208559 have proposed toners containing as a binder resin a non-linear polyester resin formed from monomer components including an etherified bisphenol monomer, a dicarboxylic acid monomer, a polyhydric alcohol having three or more functional groups and/or a polycarboxylic acid monomer having three or more functional groups. These toners are provided with an improved anti-offset performance by using as a binder resin a polyester resin obtained by reacting an etherified bisphenol monomer and a dicarboxylic acid monomer to form a polyester and crosslinking the polyester with a large amount of a polyhydric alcohol having at least three functional groups and/or a polybasic carboxylic acid having three or more functional groups. However, such a toner is caused to have a somewhat higher softening point, and it is difficult to exhibit a good low-temperature fixability. Further, when used in full-color image formation, a color toner containing the polyester resin can exhibit an improved anti-high temperature offset characteristic, but is liable to exhibit insufficient low-temperature fixability and sharp melting characteristic, thus failing to exhibit sufficient color fixability and color reproducibility. It has been also proposed to use a polyester resin comprising as a main chain a non-linear copolymer formed from an etherified bisphenol monomer, and a polyhydric alcohol monomer having three or more functional groups and/or a polycarboxylic acid monomer having three or more groups, and a side chain of a saturated or unsaturated aliphatic hydrocarbon group having 3–22 carbon atoms in JP-A 57-109825, JP-A 62-78568, JP-A 62-78569, JP-A 59-7960, and JP-A 59-29256. Such polyester resins are principally intended to be used for constituting black toners for high-speed copying. These polyester resins have an elasticity-weighted viscoelasticity in contrast with the above-mentioned viscosity-weighted polyesters, so as to remarkably reduce high-temperature offset onto the heating roller due to an enhanced elasticity. The hot pressure fixation of the toner is effected by increasing the pressure and heat of the hot pressure fixing device as high as possible and pushing the toner in a half-melted state between fiber constituting transfer papers.

Accordingly, these toners are not completely melted to provide a continuous film, thus it is almost impossible to form a toner layer having a smooth surface. The fixed toner is present in the form of particles on the transfer paper, and the resultant color image is liable to be somber and insufficient in saturation. OHP images obtained by fixation of the toner is liable to cause light scattering at the toner particle surface, thus scarcely allowing light transmission. This is practically undesirable.

Theoretically, three color toners of three primary colors of yellow, magenta and cyan can reproduce almost all colors, and ideally all hues at any density levels by subtractive color mixing. Actually, however, there remain several points to be still improved for toners, such as spectral reflection characteristic, and lowering in fixability and saturation at the time of superposition of toners.

In the case of forming "black" by superposition of three color toners, toner layers three times in amount compared with a single color toner are formed on transfer paper, so that a further difficulty is encountered in providing a good anti-offset characteristic.

There are increasing demands for a high image quality of full-color image formed by electrophotography. Ordinary users accustomed to printed full-color images, require a higher level of full-color images formed by electrophotography, that are closer to printed images and photographic images formed by using a silver salt photosensitive material.

A solution in reply to such demands may be given by uniform dispersion of a colorant in toner particles.

JP-A 61-117565 and JP-A 61-156054 disclose a process for obtaining a toner by preliminarily dissolving and/or dispersing a binder resin, a colorant and a charge control agent, etc., in a solvent, and then removing the solvent to obtain a toner. This method is accompanied with difficulties, such that the control of dispersion of the charge control agent in the binder resin is difficult, and the solvent is liable to remain in the toner as the final product to leave an odor. In the case where the solvent is an aromatic solvent, such as xylene or toluene, or a ketone solvent, such as methyl ethyl ketone or acetone, not only the odor but also the influence thereof to the human health should be considered.

JP-A 61-91666 discloses a toner production process using a halogen-containing solvent. A halogen-containing solvent has a strong polarity so that the usable colorant is undesirably restricted.

JP-A 4-39671, JP-A 4-39672 and JP-A 4-242752 disclose a process for producing a toner in a kneader under application of heat and pressure. The process is preferable for dispersion of a colorant in a binder resin, but the molecular chains of the binder resin constituting the toner are liable to be severed due to a strong kneading force, thus causing partial molecular weight reduction of the polymer components. As a result, high-temperature offset is liable to be caused in the fixing step. Particularly, in full-color image formation, three or four layers of color toners are fixed, so that the high temperature offset becomes noticeable due to the molecular weight reduction caused by molecular severance of the polymer components.

On the other hand, in the case of using a conventional sharp-melting resin showing excellent color reproducibility, a large shearing force does not act during kneading of the resin and a colorant, so that the dispersion of the colorant is liable to be insufficient. This tendency becomes noticeable especially when using a pigment having high agglomeratability as a colorant.

Accordingly, a resin design and a colorant selection are very important so as to satisfy both anti-offset property and fixability and also a satisfactory dispersibility of the colorant.

In the case of using a two-component type developer comprising a toner and a carrier, the carrier is charged to a desired charge level and a desired polarity through friction with the carrier and is used to develop an electrostatic image owing to the electrostatic force. Accordingly, the toner is required to have a good triboelectric chargeability in order to provide a good toner image.

In recent years, there is an increasing demand in market for a copying machine or a printer capable of providing high resolution and high quality images. Accordingly, there have been attempts to use a color toner of a smaller particle size to realize a higher quality color image. As the toner particle size is decreased however, the surface area per unit weight is increased and the chargeability of the toner tends to be increased, thus the toner is liable to form images of lower density and to provide inferior continuous image forming performances. Further, because of a larger toner chargeability, the toner particles exert a strong attachment force therebetween and show a lower flowability, thus giving rise to problems regarding stable toner replenishment and triboelectric charging of the toner.

Further, as a color toner does not contain a magnetic material or a black electroconductivity-imparting substance, such as carbon black, the color toner has insufficient sites for charge leakage and tends to be excessively charged. This tendency is particularly noticeable when a polyester resin having a high negative chargeability is used as the binder resin.

At present, a polyester resin is frequently used as a binder resin for color toners. A yellow color toner comprising a polyester resin, however, is generally liable to be affected by temperature and humidity, thus being liable to cause difficulties, such as an excessive charge in a low humidity environment. Accordingly, it has been desired to develop a yellow color toner exhibiting a stable chargeability under a wide variety of environment conditions.

It has been known that the chargeability of a yellow color toner is remarkably changed depending on the degree of dispersion of a yellow colorant in the binder resin, and a yellow color toner containing a yellow colorant at a poor dispersibility is liable to cause problems, such as fog and toner scattering, spent toner attachment onto the carrier, toner filming on the photosensitive drum, and soiling on the fixing roller. Accordingly, an improved dispersion of a yellow colorant is an important subject from viewpoints other than color reproducibility.

A large number of colorants for yellow toners have been known. Examples thereof include: dyes, such as C.I. Solvent Yellow 112 (as disclosed in JP-A 2-207273), C.I. Solvent Yellow 160 (JP-A 2-207274), and C.I. Solvent Yellow 162 (JP-A 8-36275); and pigments, such as a benzidine-type yellow pigment (JP-A 50-62442), a monoazo-type yellow pigment (JP-A 2-87160), and C.I. Pigment Yellow 120, 151, 154 and 156 (JP-A 2-208662).

However, as for such colorants for yellow toners known heretofore, the dye-type colorants are excellent in transparency but are inferior in light-fastness, thus leaving a problem regarding the storage stability of the resultant images.

The above-mentioned pigment-type yellow colorants show better light-fastness than the dyes but the light-fastness is inferior to quinacridone pigments used in magenta toners and copper phthalocyanine pigments used in cyan toners, thus leaving a problem of causing fading or hue change after long hours of exposure to light.

On the other hand, known yellow pigments having excellent light-fastness and heat resistance have too strong a masking power to result in a toner showing a remarkably lower transparency, which is unsuitable for full-color image formation.

Japanese Patent Publication (JP-B) 2-37949 has proposed a group of disazo compounds having excellent light-fastness (as represented by C.I. Pigment Yellow 180) and a process for production thereof. These are a type of azo pigments not only having excellent light-fastness and heat resistance but also satisfying a requirement from an ecological viewpoint.

Yellow toners using C.I. Pigment Yellow 180 are disclosed in JP-A 6-230607, JP-A 6-266163 and JP-A 8-262799, but such yellow toners have an insufficient coloring power and do not have necessarily good transparency, thus leaving room for improvement as yellow toners for full-color image formation.

JP-A 8-209017 (corr. to CA-A 2159872 and EP-A 705886) discloses an electrophotographic toner having increased transparency and coloring power in order to solve the above-mentioned problems, obtained by using a yellow pigment formed by reducing the particle size of a yellow pigment to provide an increased specific surface area. However, a pigment classified under C.I. Pigment Yellow 180, when reduced in particle size, is caused to have a remarkably lowered negative chargeability thereof, thus resulting in a toner which is accompanied with a new problem of insufficient chargeability, particularly in a high temperature/high humidity environment.

Moreover, the colorant has strong self-agglomeratability and is therefore not readily dispersed in a toner-constituting binder resin. According to our knowledge, such as a toner containing an insufficiently dispersed colorant causes a difficulty in stabilization of chargeability, and other problems, such as fog and toner scattering.

SUMMARY OF THE INVENTION

A generic object of the present invention is to provide a yellow toner for developing electrostatic images having solved the above-mentioned problems.

A more specific object of the present invention is to provide a yellow toner for developing electrostatic images, having good low-temperature fixability, excellent anti-offset characteristic, a high coloring power, excellent transparency, excellent light-fastness and discoloration resistance.

Another object of the present invention is to provide a yellow toner for developing electrostatic images capable of forming a fixed image having a high gloss.

Another object of the present invention is to provide a yellow toner for developing electrostatic images comprising toner particles wherein a yellow pigment is finely and uniformly dispersed.

Another object of the present invention is to provide a yellow toner for developing electrostatic images, having an excellent negative triboelectric chargeability.

Another object of the present invention is to provide a yellow toner for developing electrostatic images, having excellent color-mixability in full-color image formation.

A further object of the present invention is to provide a yellow toner for developing electrostatic images, less liable to cause toner melt-sticking onto parts in a developing apparatus, such as a developing sleeve, a blade and an application roller.

A still further object of the present invention is to provide a yellow toner for developing electrostatic images, less liable to cause toner filming onto a photosensitive member for bearing an electrostatic image thereon.

A further object of the present invention is to provide a yellow toner for developing electrostatic images, less liable to soil a heating roller or a pressure roller, or cause winding of a transfer-receiving material onto a heating roller, in a fixing device.

According to the present invention, there is provided a yellow toner for developing electrostatic images, comprising: yellow toner particles containing a binder resin and a yellow colorant, wherein the yellow toner has a storage modulus $G'_{180}$ at 180° C. and a minimum storage modulus $G'_{min(120\text{-}170)}$ in a temperature range of 120–170° C. giving a ratio $[G'_{180}/G'_{min(120\text{-}170)}]$ of 2.0–8.0;

the binder resin comprises a polyester resin having a glass transition temperature of 50–65° C. and an acid value of 2.0–25.0 mgKOH/g;

the yellow toner comprises a compound represented by Formula (1) below:

Formula (1):

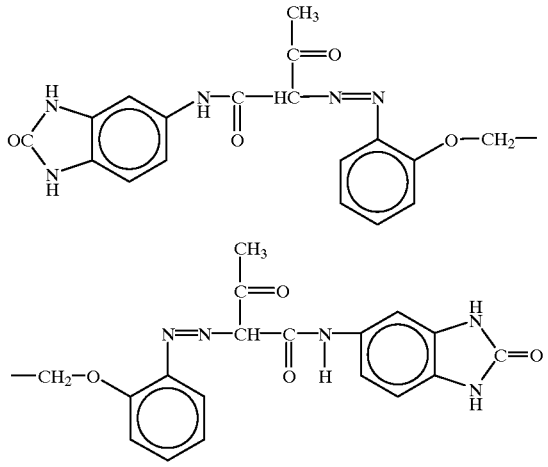

the yellow colorant comprises primary particles giving a length/breadth ratio of at most 1.5; and the yellow colorant is dispersed in the toner particles as independent particles (including primary particles and secondary particles) providing a number-average particle size of 0.1–0.7 μm.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
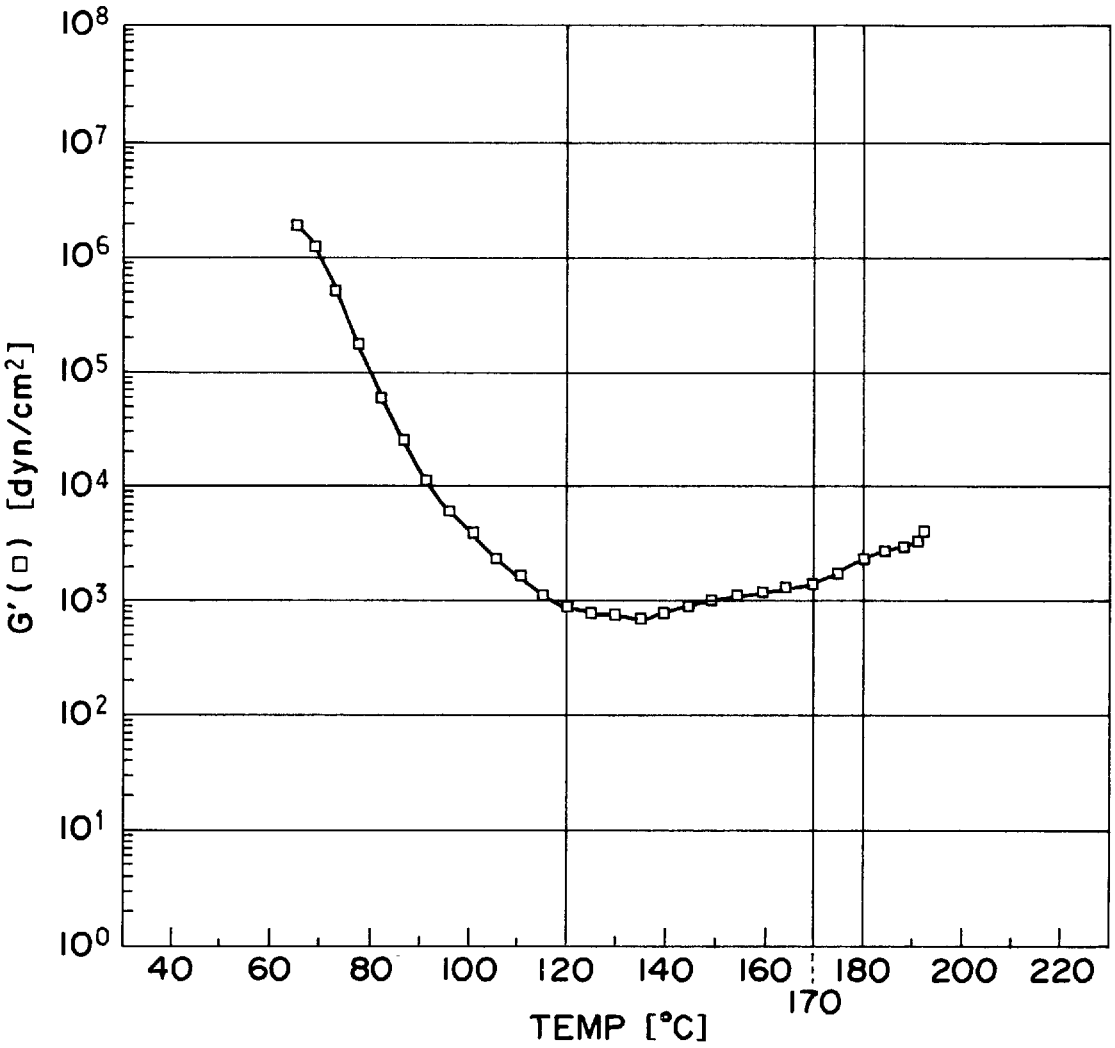
FIG. 1 is a graph showing a storage modulus curve of a yellow toner (Example 1) according to the invention.

The yellow pigment (C.I. Pigment Yellow 180) represented by the above-mentioned Formula (1) ordinarily comprises an acicular crystal and particle form of primary particles including a large proportion of primary particles having a length (i.e., longer- or major-axis diameter) of ca. 0.3–ca. 0.5 μm. It is difficult for such a yellow pigment in the form of primary particles and secondary particles to provide a kneaded product having a high transparency through melt-kneading with a binder resin. As mentioned before, JP-A 8-209017 (corr. to CA-A 2159872 and EP-A 705886) discloses an electrophotographic toner containing an azo-type yellow pigment which is represented by Formula (1), has a BET specific surface area larger than 45 $m^2/g$, and comprises fine particles showing a length/breadth (or loner-axis/shorter-axis) ratio of at most 1.6. Even such an azo-type yellow pigment as disclosed in JP-A 8-209017 comprising fine primary particles shows strong self-agglomeratability and cannot be readily dispersed in a finely dispersed secondary particle state in a binder resin in case where it is simply melt-kneaded with an ordinary binder resin.

In the present invention, a polyester resin having a glass transition temperature of 50–65° C. and an acid value of 2–25 mgKOH/g is used as a binder resin to provide a toner-forming resin composition having a viscoelasticity characteristic including a storage modulus G' which increases under heating, whereby an azo-type yellow pigment represented by Formula (1), having a number-average particle size (i.e., length-average particle size) of 0.1–0.7 μm and including primary particles showing a length/breadth ratio of at most 1.5, is dispersed in the form of fine independent particles uniformly in the binder resin.

The yellow toner according to the present invention containing the compound of Formula (1) as a yellow colorant in a finely dispersed state shows a hue of greenish yellow and has a spectral characteristic preferable as a yellow toner for full-color image formation. The yellow toner containing the compound of Formula (1) in a finely dispersed state also exhibits high lightness and saturation. In full-color image formation, it is sometimes important to well reproduce a human skin color, and the yellow toner of the present invention allows a good reproduction of a human skin color and can provide an OHP sheet carrying a color image capable of providing a projected image showing a good transparency by using an overhead projector (OHP).

In the yellow toner of the present invention, it is important that the yellow colorant is contained in the yellow toner particles in a highly dispersed state. Accordingly, the yellow colorant in the toner particles is required to be present in the form of independent particles (including primary particles and secondary particles) showing a number-average particle size of 0.1–0.7 μm. It is further preferred that the yellow colorant in the toner particles are dispersed to provide a controlled dispersed particle size distribution including at least 60% by number, preferably at least 65% by number, most preferably at least 70% by number, of independent particles having particle sizes of 0.1–0.5 μm, and 0–10% by number, preferably 0–5% by number, of independent particles having particle sizes of 0.8 μm or larger.

A number-average particle size larger than 0.7 μm of yellow colorant means that a large proportion of yellow colorant particles are present in a not sufficiently dispersed state in the toner particle, thus failing to provide a good color reproducibility and a transparency film showing a good transparency. Further, if the yellow colorant particles in the toner particles are present in a non-uniform agglomerated state, the fluctuation of charge among individual toner particles becomes noticeable to result in a broad triboelectric charge distribution. As a result, it is impossible to form a high-quality yellow color image, and it becomes also difficult to provide a good full-color image.

It is preferred that the yellow colorant in the toner particles are dispersed so that at least 60% by number, more preferably at least 65% by number, most preferably at least 70% by number, of independent particles have particle sizes in the range of 0.1–0.5 μm.

Hitherto, when the dispersed particle size of a colorant is discussed, a great importance has been attached to only an average particle size, but it is very important to have an appropriate dispersed colorant particle size distribution in order to provide an improved color reproducibility.

A broad distribution of dispersed colorant particle sizes results in a large difference in degree of dispersion of colorant particles among individual toner particles. If the colorant dispersion is poor, random reflection of light is caused by insufficiently dispersed relatively large colorant particles, so that it becomes difficult to accomplish a desired color reproducibility. Particularly, in the subtractive color-mixing process according to superposition of three colors, magenta, cyan and yellow, it is preferred that the yellow colorant has a dispersed particle size distribution as narrow as possible so as to utilize the spectral reflection characteristic at the maximum.

The colorant in fine particle sizes of below 0.1 μm is not believed to exert adverse effects to the light reflection and absorption characteristics. Colorant particles not below 0.1 μm contribute to a good color reproducibility and a good transparency of an OHP sheet having a fixed image thereon. On the other hand, the presence of colorant particles having sizes exceeding 0.5 μm in a large percentage are liable to result in an OHP sheet giving projected images having lower brightness and saturation.

Accordingly, it is preferred that the yellow colorant particles in the toner particles are dispersed to provide independent particles including at least 60% by number, more preferably at least 65% by number, further preferably at least 70% by number of particles having sizes of 0.1–0.5 μm. If particles having sizes of 0.1–0.5 μm of the colorant of Formula (1) are present in such a prescribed amount in the toner particles, the lowering in light-fastness of the yellow toner can be suppressed and the yellow hue is tinged greenish, thus providing a follow toner suitable for full color formation.

It is preferred that the yellow colorant particles in the toner particles are dispersed to provide independent particles including 0–10% by number, more preferably 0–5% by number of particles of 0.8 μm or larger. Thus, it is basically preferred that the particles of 0.8 μm or larger are not present or are present in a proportion as small as possible. In case where yellow colorant particles of 0.8 μm or larger are present in a proportion exceeding 10% by number in the toner particles, a substantial proportion of such large colorant particles are liable to be present in proximity to the surfaces of yellow toner particles, thus being liable to be liberated from the toner particle surfaces to cause difficulties, such as fog, soiling on the drum, and cleaning failure. Further, when such a yellow toner is used in a two-component type developer, the problem of carrier soiling is caused, so that it becomes difficult to form stable images in a continuous image formation on a large number of sheets. It is also difficult to obtain a good color reproducibility and a uniform chargeability.

The yellow toner according to the present invention may contain the yellow colorant of Formula (1) in a proportion of 1–15 wt. parts, preferably 3–12 wt. parts, more preferably 4–10 wt. parts, per 100 wt. parts of the binder resin.

In case where the yellow colorant is contained in excess of 15 wt. parts, the toner is caused to have a lower transparency and is liable to have a lower reproducibility of an intermediate color as represented by a human skin color. Further, the stability of triboelectric chargeability of the toner is lowered, and it becomes difficult to obtain an objective negative triboelectric charge.

In case where the yellow colorant content is smaller than 1 wt. part, it becomes difficult to obtain an objective coloring power and thus a high-quality image having a high image density.

The polyester resin constituting the binder resin of the yellow toner according to the present invention may have an acid value of 2–25 mgKOH/g so as to facilitate a gradual increase in viscosity of a kneaded mixture during the melt-kneading, and so that the resultant yellow toner is provided with excellent charge stability in various environments.

In case where the polyester resin has an acid value of below 2 mgKOH/g, it is difficult to increase the viscosity of the kneaded material during the melt-kneading, and the resultant yellow toner is liable to be excessively charged in a low temperature/low humidity environment to provide lower-density images. Further, the dispersibility of the yellow colorant of Formula (1) in the binder resin is lowered, so that individual yellow toner particles are liable to be provided with different charges, thus being liable to cause slight fog in a long period of continuous image formation.

In case where the polyester resin has an acid value exceeding 25 mgKOH/g, the resultant yellow toner is liable to have a lower stability of charge with time, thus being provided with a lower charge with the progress of a continuous image formation. Particularly, image defects, such as toner scattering and fog are liable to occur in a high temperature/high humidity environment. Further, it becomes difficult to block the yellow colorant of Formula (1) from moisture adsorption.

The polyester resin may preferably have an acid value of 3–22 mgKOH/g, more preferably 5–20 mgKOH/g.

Further, in view of the preservability, fixability and color-mixability with another color toner of the yellow toner, the polyester resin may have a glass transition temperature of 50–65° C., preferably 52–65° C., more preferably 53–64° C.

In case where the polyester resin has a glass transition temperature below 50° C., the resultant yellow toner may have an excellent fixability but is caused to have a lower anti-offset property and is liable to cause soiling on the fixing roller and winding about the fixing roller.

In case where the polyester resin has a glass transition temperature exceeding 65° C., the resultant toner is caused to have a lower fixability so that the set fixing temperature of the copying machine or printer has to be raised. Moreover, the resultant image is liable to have a lower gloss and exhibit a lower color mixability with another color toner.

The polyester resin used in the present invention may preferably have a number-average molecular weight (Mn) of 1,500–50,000, more preferably 2,000–20,000, a weight-average molecular weight (Mw) of 6,000–100,000, more preferably 10,000–90,000, and an Mw/Mn ratio of 2–8. A polyester resin satisfying the above-mentioned molecular weight conditions may provide a good thermal fixability and an improved dispersibility of the yellow colorant, thus providing a yellow toner suffering from little fractuation in chargeability to provide reliably good image quality.

In case where the polyester resin has an Mn below 1,500 or an Mw below 6,000, the resultant yellow toner may provide fixed images having a high surface smoothness and a clear appearance, but is liable to cause offset in a continuous image formation on a large number of sheets. Further, the toner is liable to have a lower storage stability and cause toner sticking in the developing device and spent toner accumulation on the carrier surface. Further, it becomes difficult to apply a shearing force during melt-kneading of the toner materials for toner particle production, thus resulting in a lower dispersibility of the yellow colorant and a product yellow toner having a fluctuating triboelectric chargeability.

In case where the polyester resin has an Mn exceeding 50,000 or an Mw exceeding 100,000, the resultant yellow toner may have excellent anti-offset property but requires a high set fixing temperature. Further, even if the dispersibility of the colorant can be controlled, the toner is liable to provide a fixed image having a lower surface smoothness and exhibit a lower color reproducibility.

In case where the polyester resin has an Mw/Mn ratio below 2, the polyester resin is generally liable to have also a low molecular weight so that, similarly as in the above-mentioned case of a small molecular weight, the resultant toner is liable to cause difficulties, such as offset phenomenon during continuous image formation, a lowering in storage stability, occurrence of toner sticking and spent toner accumulation on the carrier in the developing device and blocking of the yellow toner.

In case where the polyester resin has an Mw/Mn ratio exceeding 8, the resultant toner may have an excellent anti-offset characteristic but requires an inevitably high fixing temperature and results in images having a lower surface smoothness and a lower color reproducibility even if the pigment dispersion can be adequately controlled.

A characteristic feature of the yellow toner according to the present invention is that it has viscoelasticity characteristics including a storage modulus $G'_{180}$ at 180° C. and a minimum storage modulus $G'_{min(120\text{-}170)}$ in a temperature range of 120–170° C., respectively as measured at a frequency of 3.14 rad/sec., giving a ratio therebetween satisfying:

$$2.0 \leqq G'_{180}/G'_{min(120\text{-}170)} \leqq 8.0.$$

A $G'_{180}/G'_{min(120\text{-}170)}$ ratio of below 2.0 means that the toner-constituting resin composition causes only a small increase in viscosity with time under heating. As a result, it is difficult to apply a sufficient sharing force to the yellow colorant so as to disintegrate and finely disperse agglomerated coarse secondary particles of the yellow colorant during the melt-kneading step. On the other hand, in the case of a $G'_{180}/G'_{min(120\text{-}170)}$ exceeding 8.0, the resultant yellow toner is provided with an elasticity excessively enhanced on a higher temperature side, so that the yellow toner is liable to have a lower fixability during hot-pressure fixation and a lower color mixability with another color toner.

As an example of preferred method for providing a yellow toner having a $G'_{180}/G'_{min(120\text{-}170)}$ adjusted in the range of 2.0–8.0, a metal compound of an aromatic carboxylic acid may be added as a constituent of yellow toner particles so as to form anew a metal crosslinkage structure in a polyester resin having an acid value of 2.0–25.0 mgKOH/g crosslinked with a polybasic carboxylic acid.

The yellow toner according to the present invention may preferably have a softening temperature Tm as derived from a flow tester curve satisfying: 85° C.≦Tm≦120° C.

A yellow toner having a softening point Tm exceeding 120° C. may exhibit excellent anti-offset property but requires an inevitably high fixing temperature. Further, even if the degree of pigment dispersion is adequately controlled, the resultant images are liable to have a lower surface smoothness and fail in accomplishing a high color-reproducibility.

A yellow toner with Tm below 85° C. may provide fixed images having a high surface smoothness and a clearer appearance, but is liable to cause offset in a continuous image formation and other difficulties such as insufficient storage stability and melt-sticking of the yellow toner in the developing apparatus. The yellow toner may further preferably have a softening temperature Tm of 90–115° C.

Examples of dibasic acid components or esters thereof preferably used for providing the polyester resin in the present invention may include: dicarboxylic acids, such as terephthalic acid, isophthalic acid, phthalic acid, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid, 1,2-diphenoxyethane-p,p'-dicarboxylic acid, and esters thereof. Examples of other acid components or esters thereof may include: maleic acid, fumaric acid, glutaric acid, cyclohexanedicarboxylic acid, succinic acid, malonic acid, adipic acid, mesaconic acid, itaconic acid, citraconic acid, sebacic acid, and anhydrides and lower alkyl esters of these acids.

Examples of preferred dihydric alcohols may include: diols represented by the following Formula (2):

(2)

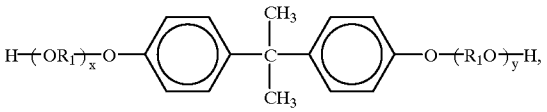

wherein $R_1$ denotes an alkylene group having 2–5 carton atoms, x and y are independently a positive number satisfying $2 \leqq x+y \leqq 8$. In order to adjust the $G'_{180}/G'_{min(120\text{-}170)}$ ratio of the yellow toner in the rane of 2.0–8.0, the group $R_1$ may preferably be an ethylene group.

Examples of other dihydric alcohol components may include: diols, such as ethylene glycol, diethylene glycol, triethylene glycol, 1,2-propylene glycol, 1,3-propylene glycol, 1,4-butanediol, neopentyl glycol, and 1,4-butenediol; 1,4-bis(hydroxymethyl)cyclohexane, and hydrogenated bisphenol A.

In order to provide the polyester resin with a crosslinked structure in advance, it is preferred to includes as a constituent of the polyester resin a polycarboxylic acid of the following formula (3):

(3)

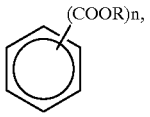

wherein n is an integer of at least 3, and at least 3 groups R independently denote a hydrogen atom, an alkyl group having 1–18 carbon atoms, an alkenyl group having 2–18 carbon atoms, or an aryl group having 6–18 carbon atoms; or an anhydride of the polycarboxylic acid.

Specific examples of the polycarboxylic acid may include: trimellitic acid, tri-n-ethyl 1,2,4-benzenetricarboxylate, tri-n-butyl 1,2,4-benzenetricarboxylate, tri-n-hexyl 1,2,4-benzenetricarboxylate, tri-isobutyl 1,2,4-benzenetricarboxylate, tri-n-octyl 1,2,4-benzenetricarboxylate, and tri-2-ethylhexyl 1,2,4-benzenetricarboxylate, pyromellitic acid, and tetra-methyl ester and tetra-ethyl ester of 1,2,4,5-benzenetetetracarboxylic acid.

It is also preferred that the polyester resin used in the present invention is produced by using an alkyl-substituted or alkenyl-substituted acid, such as maleic acid, fumaric acid, glutaric acid, succinic acid, malonic acid or adipic acid having a substituent group of n-dodecenyl, isododecenyl, n-dodecyl, isododecyl or iso-octyl and/or an alkyl-subsitute or alkenyl substituted alcohol, such as ethylene glycol, 1,3-propylenediol, tetramethylene glycol, 1,4-butylenediol or 1,5-pentenediol having a substitute group of n-dodecenyl, isododecenyl, n-dodecyl, isododecyl or iso-octyl.

The polyester resin may be produced through a process, as described below for example.

First, a linear condensate is formed while controlling the molecular weight thereof so as to provide an acid value and a hydroxyl value which are 1.5 to 3 times the objective values. The condensation reaction may preferably be proceeded more slowly and gradually than a conventional process so as to provide a uniform molecular weight. The esterifying reaction may be controlled, e.g., by (i) using a lower temperature and longer hours for the reaction than usual, (ii) using monomers (alcohol and/or acid) having a lower reactivity, or (iii) combining these measures. Thereafter, a crosslinking component and optionally an additional amount of monomers may be added to further proceed the esterification, thereby forming a polyester resin. The temperature is further raised and the crosslinking esterification is proceeded slowly for long hours so as to provide a uniform molecular weight distribution. Then, the reaction is terminated when the acid value or hydroxyl value and the MI (metal index) value are lowered down to the objective values to obtain an objective polyester resin.

In order to provide a $G'_{180}/G'_{min(120\text{-}170)}$ ratio in the range of 2.0–8.0, it is preferred to incorporate an aromatic carboxylic metal compound in the toner particles. If the polyester resin having a glass transition temperature of 50–65° C. and an acid value of 2.0–25.0 mgKOH/g, the yellow colorant of Formula (1) having a length/breadth ratio of primary particles of at most 1.5 and a number-average particle size of 0.1–0.7 $\mu$m, and such an aromatic acid carboxylic acid, are together subjected to melt-kneading, a partial metal crosslinkage structure is formed in the polyester resin, so that the melt viscosity of the kneaded product is gradually raised during the melt-kneading. As a result, the melt viscosity of the kneaded product is significantly raised compared with that of the binder resin alone. Accordingly, even if the starting yellow colorant contains coarse secondary particles because of a strong self-agglomeratability due to fine primary particle size, the coarse secondary particles can be disintegrated into primary particles and/or fine secondary particles under a sufficient shearing force acting thereon during the melt-kneading. As a result, a melt-kneaded product containing primary particles and fine secondary particles uniformly dispersed therein can be efficiently produced.

While the detailed mechanism has not been clarified as yet, it is assumed that the imino group sites of the yellow colorant of Formula (1) and the carbonyl group sites originated from carboxylic groups of the poyester resin form a hydrogen bond or a bond due to an electrostatic interaction therebetween to enhance the dispersibility of the yellow colorant in the polyester resin and suppress moisture adsorption on the ester bond sites of the molecular chain of the polyester resin, thereby suppressing a lowering in chargeability of the yellow toner in a high temperature/high humidity environment. The aromatic carboxylic acid metal compound also functions as a negative charge control agent for increasing and stabilizing the negative chargeability of the yellow toner.

Examples of preferred species of the aromatic carboxylic acid for providing such metal compound may include: salicylic acid, mono-alkylsalicylic acids and dialkylsalicylic acids. Dialkylsalicylic acids are preferred, and di-tert-butylsalicylic acid is particularly preferred.

Thus, examples of the aromatic acid metal compounds may includes: metal salts and metal complexes of salicylic acid, metal salts and metal complexes of alkylsalicylic acids, and metal salts and metal complexes of dialkylsalicylic acids.

In the present invention, it is preferred to use aluminum as metal species for providing the aromatic carboxylic acid metal compound. This is because the crosslinking reaction of the polyester resin during the melt-kneading easily proceeds with an aluminum compound than a metal compound of another metal species, such as zinc.

Such an aromatic acid metal compound may preferably be contained in the yellow toner particles in a proportion of 2–10 wt. parts, more preferably 3–8 wt. parts, per 100 wt. parts of the binder resin. The proportion of 2–10 wt. parts per 100 wt. parts of the binder resin is preferred because the crosslinking reaction with the polyester resin during the melt-kneading easily proceeds thereby, the yellow colorant is finely and uniformly dispersed in the polyester resin thereby, and the negative chargeability of the resultant yellow toner is adjusted in a suitable range. If the aromatic carboxylic acid metal compound is less than 2 wt. parts, the metal crosslinkage portion in the polyester resin is little, so that the melt viscosity increase is not caused or insufficient, and also little negative charge control effect is given to the yellow toner. If the aromatic carboxylic acid metal compound is more than 10 wt. parts, the polyester resin is provided with excessive metal crosslinkage portion, thus resulting in a yellow toner having a lower low-temperature fixability and a lower color mixability with another color toner. Further, the yellow toner is liable to be excessively charged in a low temperature/low humidity environment.

The yellow toner according to the present invention is designed to exhibit heat and pressure fixation performances including excellent quick meltability on a low temperature side and resistance to offset by an enhanced elasticity on a high temperature side by using a specific polyester resin and an aromatic carboxylic acid metal compound to cause a crosslinking reaction through mutual interaction, thereby increasing the shearing force acting on the secondary particles of the yellow colorant to finely and uniformly disperse the yellow colorant.

In the yellow toner particles of the present invention, it is also possible to incorporate as a lubricant an aliphatic acid metal salt, such as zinc stearate, or aluminum stearate, or fine powder of a fluorine-containing polymer, such as polytetrafluoroethylene, polyvinylidene fluoride, or tetrafluoroethylene-vinylidene fluoride copolymer; or an electroconductivity-imparting agent, such as tin oxide or zinc oxide, as desired.

It is sometimes preferred to also incorporate a release agent as a fixing aid in the yellow toner particles. Examples thereof may include: aliphatic hydrocarbon waxes and oxidized products thereof, waxes consisting principally of aliphatic acid esters, saturated linear aliphatic acids, unsaturated aliphatic acids, saturated alcohols, polyhydric alcohols, aliphatic acid amides, saturated aliphatic acid bisamides, unsaturated aliphatic acid amides, and aromatic bisamides, which are generally solid at room temperature. The release agent may be contained in 0.1–20 wt. parts, preferably 0.5–10 wt. parts, per 100 wt. parts of the binder resin. A release agent amount exceeding 20 wt. parts is liable to provide a toner with inferior anti-blocking characteristic or inferior anti-offset property. Below 0.1 wt. part, the release effect may be minimal.

The release agent may preferably be incorporated in the binder resin by a method of dissolving the resin in a solvent and adding the release agent into the resin solution under stirring at an elevated temperature, or by a method of mixing the release agent together with other toner-constituting materials at the time of kneading the binder resin to be incorporated into the toner particles.

The yellow toner particles for providing the yellow toner according to the present invention may be prepared by uniformly blending the binder resin, the yellow colorant, the aromatic carboxylic acid metal compound and other optional additives in a blender, such as a Henschel mixer; melt-kneading the resultant blend by means of a hot kneading machine, such as hot rollers, a kneader, or an extruder to mutually dissolve and disperse the components each other; and, after cooling for solidification of the kneaded product, subjecting the kneaded product to pulverization and strict classification, to provide yellow toner particles having an objective particle size. The melt-kneading temperature may preferably be 120–170° C.

For the toner particle production, it is also possible to adopt a process wherein the yellow colorant is added to and dispersed in a portion of the binder resin in advance, and the resultant dispersed product is added to and melt-kneaded with the remainder of the binder resin, the aromatic carboxylic acid metal compound and other optional additive, followed by cooling, pulverization and classification. The preliminary dispersion of the yellow colorant in a portion of the binder resin may be effected by the master batch process or flushing treatment which per se are known heretofore.

The yellow toner particles may preferably have a weight-average particle size of 3–15 $\mu$m, more preferably 4–12 $\mu$m, most preferably 4–8 $\mu$m. Below 3 $\mu$m, it becomes difficult to accomplish the chargeability stabilization, so that the toner is liable to provide foggy images and cause toner scattering in the image forming apparatus. Above 15 $\mu$m, the yellow toner is liable to show a lower halftone reproducibility and result in rough images.

The yellow toner according to the present invention may preferably include a flowability improving agent comprising titanium oxide fine powder or aluminum oxide fine powder respectively hydrophobized (i.e., subjected to a hydrophobicity imparting treatment), having an average primary particle size of 0.005–0.1 $\mu$m and externally added to the yellow toner particles. It is important for such a flowability improving agent as an external additive to enhance the flowability of the yellow toner without adversely affecting the chargeability of the yellow toner. Accordingly, it is preferred that the titanium oxide fine powder of aluminum oxide fine powder has been surface-hydrophobized so as to satisfy the flowability improving effect and the charge stabilization effect in combination.

By hydrophobizing the titanium oxide fine powder or aluminum oxide fine powder, it becomes possible to remove the influence of moisture as a factor affecting the chargeability and reduce the chargeability difference between a high humidity environment and a low humidity environment, thereby improving the environmental stability of the yellow toner. Further, during the hydrophobization step, it is possible to disintegrate the agglomerates of primary particles, thus providing an external additive with litter secondary agglomeration.

In the present invention, it is particularly preferred to use hydrophobic titanium oxide fine powder or aluminum oxide fine powder having an average primary particle size of 0.005–0.1 μm because of good flowability and uniformization of negative chargeability of the yellow toner resulting in effective prevention of toner scattering and fog. Further, the flowability improving agent is not readily embedded at the toner particle surfaces, thus preventing toner deterioration and providing an improved continuous image forming performance on a large number of sheets. This tendency is particularly noticeable when combined with sharp-melting toner particles.

If the titanium oxide fine powder or aluminum oxide fine powder has an average primary particle size below 0.005 μm, the fine powder is liable to be embedded at the yellow toner particle surface, thus causing early deterioration of the toner and giving a lower continuous image formation performance. This tendency is particularly noticeable when used in a sharp-melting yellow toner.

On the other hand, in the case of an average primary particle size exceeding 0.1 μm, the resultant yellow toner is liable to have a lower flowability and an ununiform chargeability, thus being liable to cause a lower resolution, toner scattering and fog; so that it becomes difficult to provide high-quality toner images.

In the yellow toner according to the present invention, the titanium oxide fine powder or aluminum oxide fine powder may preferably be added in 0.5–5.0 wt. parts, more preferably 0.7–3.0 wt. parts, further preferably 1.0–2.5 wt. parts, per 100 wt. parts of the yellow toner particles. By satisfying the above ranges, the resultant yellow toner may be provided with a good flowability and stable chargeability, thus being less liable to cause toner scattering.

In case where the yellow toner according to the present invention is used as a two-component type developer, the toner may be mixed with a carrier, examples of which may include: surface-oxidized or non-oxidized particles of magnetic metals, such as iron, nickel, copper, zinc, cobalt, manganese, chromium and rare-earth metals, and magnetic alloys, magnetic oxides and magnetic ferrites of these metals.

A coated carrier comprising carrier core particles coated with a coating material may be prepared by coating the carrier core with a solution or dispersion of a coating material, such as a resin, or by simple powder blending.

The coating material attached onto the carrier core surface may for example comprise one or more species selected from polytetrafluoroethylene, monochlorotrifluoro-ethylene polymer, polyvinylidene fluoride, silicone resin, polyester resin, styrene-resin, acrylic resin, polyamides, polyvinylbutyral, and aminoacrylate resin.

The coating amount may be determined appropriately but may preferably be in a proportion of 0.01–5 wt. %, more preferably 0.05–3 wt. %, more preferably 0.10–2 wt. %, in total, of the carrier.

The carrier may preferably have an average particle size of 10–100 μm, more preferably 20–70 μm.

In a preferred mode, the carrier may be in the form of a resin-coated magnetic carrier comprising magnetic core particles of, e.g., magnetic ferrite, surface-coated with a resin, such as silicone resin, fluorine-containing resin, styrene resin, acrylic resin or methacrylic resin, at a coating rate of 0.01–5 wt. %, preferably 0.1–1 wt. %, of the resultant carrier and having an average particle size in the above-described range as well as a particle size distribution including at least 70 wt. % of carrier particles of 250 mesh-pass and 400 mesh-on.

A resin-coated magnetic ferrite carrier having a sharp particle size distribution as described above may provide a preferred triboelectric charge and improved electrophotographic performances to the yellow toner according to the present invention.

In order to provide a generally good performance in the case of constituting a two-component type developer, the yellow toner according to the present invention may be blended with the carrier so as to provide a toner concentration in the developer of 2–15 wt. %, preferably 3–13 wt. %, more preferably 4–10 wt. %. If the toner concentration is below 2 wt. %, the image density is liable to be lowered and, in excess of 15 wt. %, the toner is liable to result in fog, cause scattering in the apparatus and lower the life of the developer.

Next, an example of process for forming full-color images according to electrophotography by using a yellow toner according to the present invention will be described with reference to FIG. 3.

Figure 3:
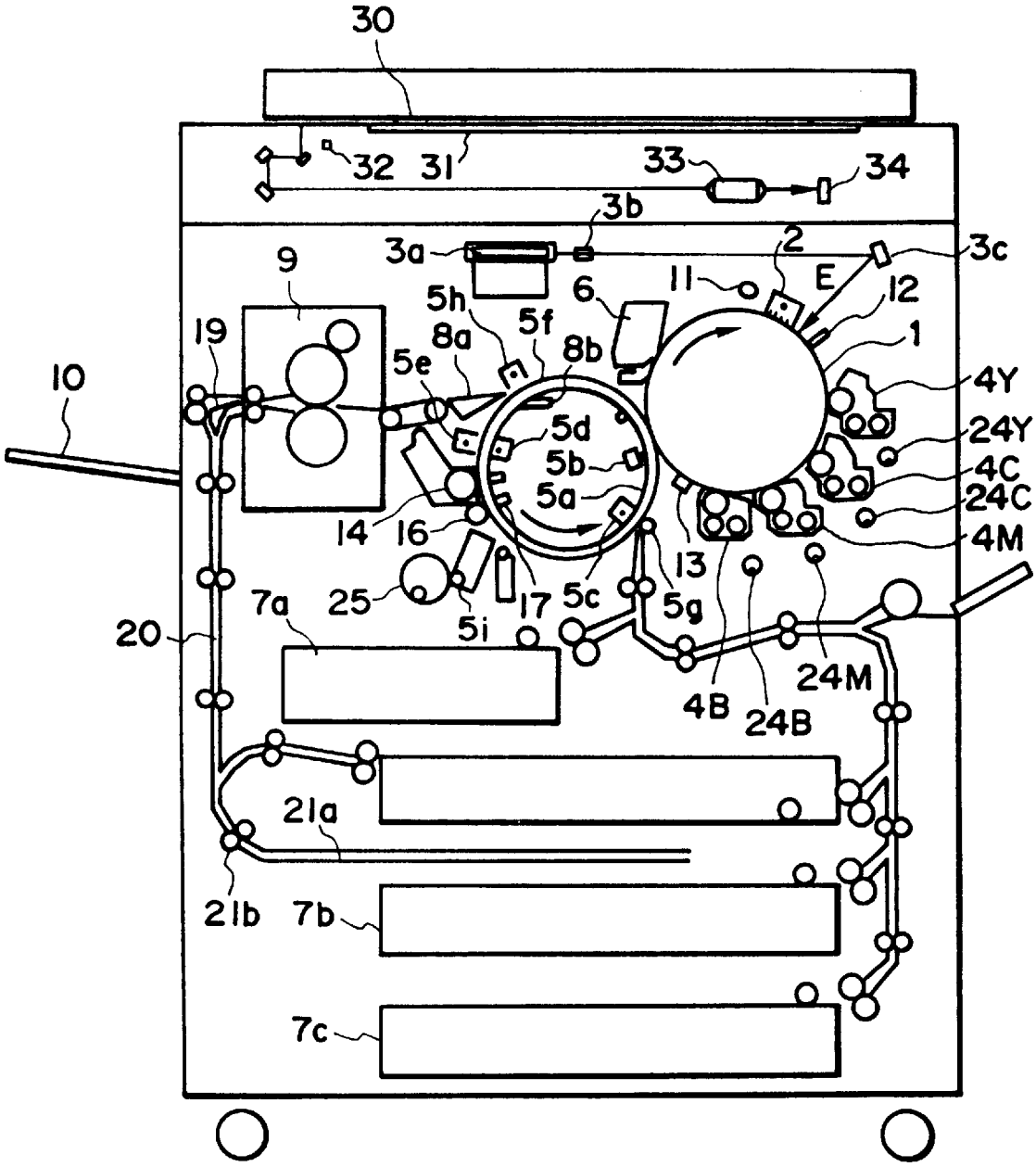
FIG. 3 is a schematic illustration of an example of full-color image forming apparatus to which a yellow toner according to the invention is applicable.

More specifically, FIG. 3 is a schematic illustration of an image forming apparatus for forming a full-color image by electrophotography. The image forming apparatus shown in FIG. 3 is applicable as a full-color copying machine or a full-color printer.

In the case of using the apparatus as a full-color copying machine, as shown in FIG. 3, the copying apparatus includes a digital color image reader unit at an upper part and a digital color image printer unit at a lower part.

In the image reader unit, an original 30 is placed on a glass original support 31 and is subjected to scanning exposure with an exposure lamp 32. A reflection light image from the original 30 is concentrated at a full-color sensor 34 to obtain a color separation image signal, which is transmitted to an amplifying circuit (not shown) and is transmitted to and treated with a video-treating unit (not shown) to be outputted toward the digital image printer unit.

In the image printer unit, a photosensitive drum 1 as an electrostatic image-bearing member may, e.g., include a photosensitive layer comprising an organic photoconductor (OPC) and is supported rotatably in a direction of an arrow. Around the photosensitive drum 1, a pre-exposure lamp 11, a corona charger 2, a laser-exposure optical system (3*a*, 3*b*, 3*c*), a potential sensor 12, four developing devices containing developers different in color (4Y, 4C, 4M, 4B), a luminous energy (amount of light) detection means 13, a transfer device, and a cleaning device 6 are disposed.

In the laser exposure optical system, the image signal from the image reader unit is converted into a light signal for image scanning exposure at a laser output unit (not shown). The converted laser light (as the light signal) is reflected by a polygonal mirror 3*a* and projected onto the surface of the photosensitive drum via a lens 3*b* and a mirror 3*c*.

In the printer unit, during image formation, the photosensitive drum 1 is rotated in the direction of the arrow and charge-removed by the pre-exposure lamp 11. Thereafter, the photosensitive drum 1 is negatively charged uniformly by the charger 2 and exposed to imagewise light E for each separated color, thus forming an electrostatic latent image on the photosensitive drum 1.

Then, the electrostatic latent image on the photosensitive drum is developed with a prescribed toner by operating the prescribed developing deice to form a toner image on the photosensitive drum 1. Each of the developing devices 4Y, 4C, 4M and 4B performs development by the action of each of eccentric cams 24Y, 24C, 24M and 24B so as to selectively approach the photosensitive drum 1 depending on the corresponding separated color.

The transfer device includes a transfer drum 5*a*, a transfer charger 5*b*, an adsorption charger 5*c* for electrostatically adsorbing or transfer-receiving material, such as transfer paper or an OHP sheet, a recording material, an adsorption roller 5*g* opposite to the adsorption charger 5*c* an inner charger 5*d*, an outer charger 5*e*, and a separation charger 5*h*. The transfer drum 5*a* is rotatably supported by a shaft and has a peripheral surface including an opening region at which a transfer sheet 5*f* as a recording material-carrying member for carrying the recording material is integrally adjusted. The transfer sheet 5*f* may include a resin film, such as a polycarbonate film.

A recording material is conveyed from any one of cassettes 7*a*, 7*b* and 7*c* to the transfer drum 5*a* via a recording material-conveying system, and is held on the transfer drum 5*a*. The recording material carried on the transfer drum 5*a* is repeatedly conveyed to a transfer position opposite to the photosensitive drum 1 in accordance with the rotation of the transfer drum 5*a*. The toner image on the photosensitive drum 1 is transferred onto the recording material by the action of the transfer charger 5*b* at the transfer position.

The toner image may be directly transferred to the recording material as shown in FIG. 3. Further, the toner image is once transferred to an intermediate transfer member and then is retransferred from the intermediate transfer member to the recording material.

The above image formation steps are repeated with respect to yellow (Y), magenta (M), cyan (C) and black (B) to form a color image comprising superposed four color toner images on the recording material carried on the transfer drum 5*a*.

The recording material thus subjected to transfer of the toner image (including four color images) is separated from the transfer drum 5*a* by the action of a separation claw 8*a*, a separation and pressing roller 8*b* and the separation charger 5*h* to be conveyed to heat and pressure-fixation device 9, at which the toner image on the recording material is fixed under heating and pressure to effect color-mixing and color development of the toner and fixation of the toner onto the recording material to form a full-color fixed image (fixed full-color image), followed by discharge thereof into a tray 10. As described above, a full-color copying operation for one sheet of recording material is completed. On the other hand, a residual toner on the surface of the photosensitive drum 1 is cleaned and removed by the cleaning device 6, and thereafter the photosensitive drum 1 is again subjected to next image formation. The cleaning member may be a fur brush or unwoven cloth instead of a blade, or can be a combination of these.

With respect to the transfer drum 5*a*, an electrode roller 14 and a fur brush 15 are oppositely disposed via the transfer sheet 5*f*, and an oil-removing roller 16 and a backup brush 17 are also oppositely disposed via the transfer sheet. By using these members, powder and/or oil attached to the transfer sheet 5*f* is cleaned and removed. This cleaning operation is performed before or after image formation. After an occurrence of jam phenomenon (paper jamming or plugging), the cleaning operation may be effected, as desired.

An eccentric cam 25 is operated at a desired timing to actuate a cam follower 5 integrally supported to the transfer drum, whereby a gap (spacing) between the transfer sheet 5*f* and the photosensitive drum can be arbitrarily set. For instance, at the time of stand-by or shut-off of power supply, the gap between the transfer drum 5*a* and the photosensitive drum 1 can be made larger.

A full-color fixed image is thus formed by the above image forming apparatus. In the above apparatus, image formation may appropriately be performed in a single color mode or a full color mode to provide a single color fixed image or a full color fixed image, respectively.

Various properties and properties described herein for characterizing the present invention are based on values respectively measured in the following manner.

Rheological Properties of Yellow Toner

A toner sample is pressure-molded into a disk having a diameter of ca. 40 mm and a thickness of ca. 2 mm. The disk sample is set between parallel plates and subjected to a temperature dispersion measurement on gradual temperature increase at a rate of 10° C./min. in the range of 50–200° C. under application of a shearing stress at a constant angular frequency (w) of 3.14 rad/sec in an automatic strain mode. The measurement is performed by using a visco-elasticity measurement apparatus (e.g., "Rheometer RDA-II", available from Rheometrics Co.). The measured storage modulus (G') characteristics may be represented by a curve on a graph drawn by taking temperature on the abscissa and G' on the ordinate (an example curve is given on FIG. 1 for a yellow toner of Example 1 described hereinafter).

Number-average Particle Size (Dav.) and Length/Breadth Ratio (RL/B) of Yellow Colorants Yellow pigment particles of a sample yellow colorant are directly observed through a scanning electron microscope, and 300 pigment primary particles enlarged at a magnification of $3\times10^4$–$5\times10^4$ and having a primary particle size of at least 0.1 $\mu$m are selected in the visual field to measure the length (longer-axis diameter) and breadth (shorter-axis diameter) of each pigment primary particle are measured to calculate an average value of length/breadth ratio ($R_{L/B}$).

Further, the average of the lengths of 300 pigment primary particles are take as the number-average particle size (Dav.) of the sample yellow colorant.

The number-average particle size and the length/breadth ratio can also be measured by observation of yellow colorant particles dispersed in yellow toner particles described below, and no substantial difference has been found between values measured according to the two methods.

Particle Size of the Yellow Colorant Particles Dispersed in Toner Particles

A sample yellow toner or sample yellow toner particles are dispersed in a 2.3 M-sucrose solution under sufficient stirring, and a small amount of the dispersion is applied onto a sample holder pin, dipped in liquid $N_2$ to be solidified and then immediately set onto a sample arm head. Then, the solidified sample is sliced by an ultra-microtome equipped with a cryostat ("FC4E", available from Nissei Sangyo K.K.) in an ordinary manner to obtain an electron microscope sample.

The sample is then observed and photographed through an electron microscope ("H-8000", available from Hitachi Seisakusho K.K.) at an acceleration voltage of 100 kV. The magnification of the photograph is selected in the range of $3\times10^4$–$5\times10^4$.

The image data of the thus-taken photograph(s) is introduced via an interface into an image analyzer ("Luzex 3", available from Nicore K.K.) to be converted into binary image data, among which up to 300 pigment particles having particle sizes of at least 0.1 $\mu$m are sampled at random and are analyzed to obtain a number-average particle size (Dav.), a particle size distribution and a length/breadth ratio ($R_{L/B}$) of sample pigment particles.

As described above, only primary and secondary particles having a particle size of at least 0.1 μm are sampled as measurement objects, and the particle size herein refers to a diameter of an approximated sphere (or circle) of a pigment particle image.

Particle Size Distribution of a Toner and Toner Particles

The particle size distribution may be measured by using a Coulter counter TA-II or Coulter Multisizer (available from Coulter Electronics Inc.).

For measurement, a 1%-NaCl aqueous solution (e.g., ISOTON R-II (available from Coulter Scientific Japan K.K.)) as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40.3 μm (13 channels) by using the above-mentioned Coulter counter with a 100 μm-aperture to obtain a volume-basis distribution and a number-basis distribution. From the results of the volume-basis distribution and number-basis distribution, parameters characterizing a toner may be obtained. More specifically, the weight-basis average particle size ($D_4$) may be obtained from the volume-basis distribution while a central value in each channel is taken as a representative value for each channel.

The above-mentioned 13 channels includes 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.00–25.40 μm: 25.40–32.00 μm; and 32.00–40.30 μm.

Incidentally, external additive particles added to yellow toner particles to provide a yellow toner generally contain extremely few particles having a particle size of 2.00 μm or larger, so that it has been confirmed that the weight-average particle size ($D_4$) of a toner containing external additives shows a substantially identical value to the weight-average particle size ($D_4$) of the corresponding toner particles from which the external additives have been removed, when measured respectively according to the above-described method.

Acid Value of Polyester Resin

2–10 g of a sample resin is accurately weighted into a 200 to 300 ml-Erlenmeyer flask, and ca. 50 ml of methanol/toluene (=30/70) mixture solvent is added thereto a solve the sample resin. In case where the solubility appears to be low, a small amount of acetone may be added. The solution is titrated with a preliminarily standardized 0.1 normal-potassium hydroxide alcohol solution in the presence of a 0.1%-Bromothymol Blue/Phenol Red mixture indicator. From the consumed volume of the KOH-alcohol solution (KOH (ml)), the acid value is calculated by the following equation:

$$\text{Acid value (mgKOH/g)}=[\text{KOH(ml)}\times N\times 56.1]/\text{sample weight},$$

wherein N represents a factor of the 0.1 normal KOH solution.

Triboelectric Chargeability

Figure 4:
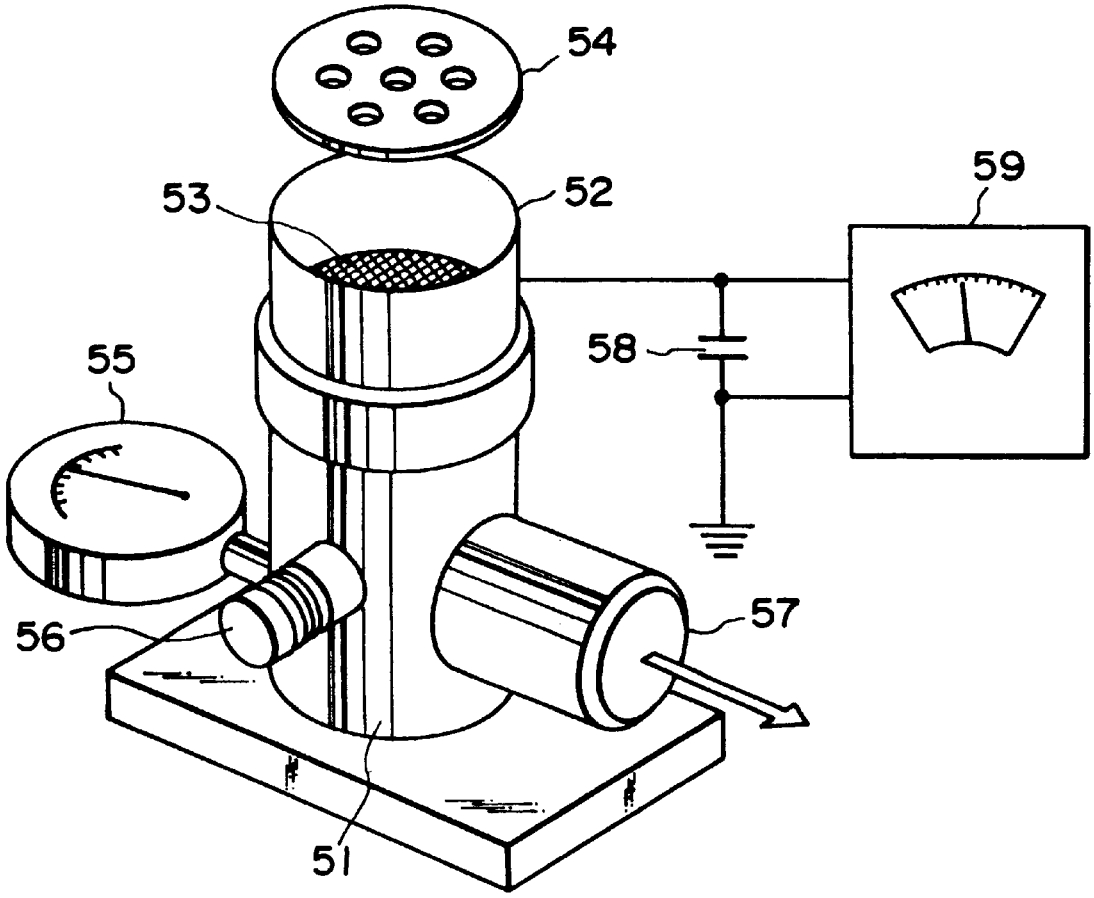
FIG. 4 is a perspective illustration of an apparatus for measuring a triboelectric chargeability of toner particles or a toner.

FIG. 4 is an illustration of an apparatus for measuring a toner triboelectric charge. A developer sampled from the surface of a developing sleeve of a copying machine or a printer, in a weight of ca. 0.5–1.5 g, is placed in a metal measurement vessel 52 bottomed with a 500-mesh screen 53 and then covered with a metal lid 54. The weight of the entire measurement vessel 52 at this time is weighed at $W_1$ (g). Then, an aspirator 51 (composed of an insulating material at least with respect to a portion contacting the measurement vessel 52) is operated to suck the toner through a suction port 57 while adjusting a gas flow control valve 56 to provide a pressure of 250 mmAg at a vacuum gauge 55. Under this state, the toner is sufficiently removed by sucking, preferably for 2 min.

The potential reading on a potentiometer 59 at this time is denoted by V (volts) while the capacitance of a capacitor 58 is denoted by C (mF), and the weight of the entire measurement vessel is weighed at $W_2$ (g). Then, the triboelectric charge Q (mC/kg) of the sample toner is calculated by the following equation:

$$Q(mC/\text{kg})=C\times V/(W_1-W_2).$$

Average Particle Size of Titanium Oxide Fine Particles or Aluminum Oxide Fine Particles As for the measurement of primary particle size, sample titanium oxide fine particles or aluminum oxide fine particles are observed through a transmission electron microscope, and 300 particles enlarged at a magnification of $3\times10^4$–$5\times10^4$ and having a particle size of at least 0.005 μm are selected in the view field to be measured with respect to particle sizes, from which an average particle size is obtained.

As for the measurement of a dispersed particle size on toner particles, sample titanium oxide or aluminum oxide fine particles on the toner particles are observed through a scanning electron microscope, and 300 particles thereof enlarged at a magnification of $3\times10^4$–$5\times10^4$ and selected in the view field to be measured with respect to particle sizes while qualitatively identifying the particles by an X-ray microanalyzer, thereby obtaining an average particle size.

Glass Transition Temperature (Tg)

Measurement may be performed in the following manner by using a differential scanning calorimeter (e.g., "DSC-7", available from Perkin-Elmer Corp.).

A sample in an amount of 5–20 mg, preferably about 10 mg, is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears in the temperature region of 40–100° C.

In this instance, the glass transition temperature (Tg) is determined as a temperature of an intersection between a DSC curve and an intermediate line passing between the base lines obtained before and after the appearance of the absorption peak.

Softening Point Temperature of Resin or Toner

A flow tester ("Model CFT-500", available from Shimadsu Seisakusho K.K.) may be used for the measurement. Ca. 1.0 g of 60 mesh-pass sample is pressed for 1 min. under a pressure of 100 kg/cm$^2$ in a mold.

The thus-prepared pressed sample is subjected to the flow tester measurement in a normal temperature/normal humidity environment (temperature: ca. 20–30° C.; humidity: 30–70% RH), to obtain a smooth temperature-apparent viscosity curve, from which a temperature (=$T_{1/2}$) at which 50% by volume of the sample has flown out is taken to represent the softening point temperature Tm of the sample resin or toner. Other conditions are as follows:

| | |
|---|---|
| RATE TEMP. | 6.0 (° C. min) |
| SET TEMP. | 50.0 (° C.) |
| MAX TEMP. | 180.0 (° C.) |
| INTERVAL | 3.0 (° C.) |
| PREHEAT | 300.0 (sec.) |
| LOAD | 10.0 (kg) |
| DIE (diameter) | 1.0 (mm) |
| DIE (length) | 1.0 (mm) |
| PLUNGER | 1.0 ($cm^2$) |

Molecular Weight Distribution of Polyester Resin

Mn, Mw and Mw/Mn of a polyester resin may be measured by gel permeation chromatography (GPC).

In the GPC apparatus, a column is stabilized in a heat chamber at 40° C., tetrahydrofuran (THF) solvent is caused to flow through the column at that temperature at a rate of 1 ml/min. Ca. 100 $\mu$l of a GPC sample is injected into the column for the measurement. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights of ca. $10^2$–$10^7$ available from, e.g., Toso K.K. or Showa Denko K.K. It is appropriate to use at least ca. 10 standard polystyrene samples. The detector may be an RI (refractive index) detector. It is appropriate to use a plurality of commercially available polystyrene gel columns in combination.

Examples thereof may include: a combination of Shodex GPC KF-801, 802, 803, 804, 805, 806, 807 and 800P, available from Showa Denko K.K.; and a combination of TSK gel G1000H ($H_{XL}$), G2000H ($H_{XL}$), G3000H ($H_{XL}$), G4000H ($X_{XL}$), G5000H ($H_{XL}$), G6000H ($H_{XL}$), G7000H ($H_{XL}$) and TSK quardcolumn, available from Toso K.K.

The sample may be prepared in the following manner.

A sample is placed in THF and, after standing for several hours, mixed sufficiently with the THF by shaking until the coalescent sample disappears, followed further by standing for at least 24 hours. Then, the sample solution is passed through a membrane filter having a pore size of 0.45–0.50 $\mu$m (e.g., "Maishori Disk H-25-5", available from Toso K.K.; and "Ekikuro Disk 25CR", available from German Science (Japan K.K.) to provide a GPC sample. The sample concentration may be adjusted to provide a resin concentration of 0.5–5 mg/ml.

Bet Specific Surface Area

BET specific surface area ($S_{BET}$) of a pigment sample may be measured according to the BET multi-point method by using nitrogen as an adsorbate gas and a full-automatic gas adsorption meter (e.g., "Autosorb 1", available from Yuasa Ionix K.K.). The sample may be pre-treated by 10 hours of gas evacuation at 50° C.

Average Particle Size of Carrier

Measurement may be performed by using a micro-track particle size analyzer ("SRA Type", available from Nikkiso K.K.) 9in9 the range of 90.7–700 $\mu$m. The measured 50% particle size is used to represent an average particle size ($D_{50}$) of the carrier.

The present invention will be described more specifically based on Examples.

EXAMPLE 1

| | |
|---|---|
| Polyester resin No. 1 | 70 wt. parts |

[a crosslinked polyester resin formed from polyoxyethylene (2)-2,2-bis(4-hydroxyphenyl)propane, terephthalic acid, fumaric acid and trimellitic acid; AV (acid value)=10.5 mgKOH/g, Tg=56° C., Mn=4000, Mw=9000, Tm=90° C.]

| | |
|---|---|
| Yellow colorant (pigment) of Formula (1) | 30 wt. parts |

[Dav.=0.25 $\mu$m, $R_{L/B}$=1.4, $S_{BET}$=62 $m^2/g$]

The above polyester resin and yellow colorant were charged in a kneader-type mixer and were sufficiently premixed under no pressure but with mixing and heating. Then, the premix was kneaded twice on a three-roll mill to obtain a first kneaded product (containing 30 wt. % of pigment particles).

| | |
|---|---|
| First kneaded product | 16.7 wt. parts |
| Polyester resin No. 1 | 88.3 wt. parts |
| Di-tert-butylsalicylic acid, aluminum compound | 4 wt. parts |

The above ingredients were sufficiently preliminarily blended in a Henschel mixer and melt-kneaded through a twin-screw extruder at 125–130° C., followed by cooling, crushing by a hammer mill into sizes of ca. 1–2 mm and fine pulverization by means of an air jet-type pulverizer. From the fine pulverizate, a fine powder fraction and a coarse powder fraction were strictly removed to recover yellow toner particles having a weight-average particle size ($D_4$) of 6.5 $\mu$m.

Separately, 100 wt. parts of hydrophillic titanium oxide fine powder (average primary particle size (Dav-1)=0.02 $\mu$m, $S_{BET}$=140 $m^2/g$) was surface-treated with 20 wt. parts of $n\text{-}C_4H_9\text{—}Si(OCH_3)_3$ to obtain Hydrophobic titanium oxide fine powder A (Dav-1=0.02 $\mu$m, hydrophobicity (HP)=70%).

100 wt. parts of the above prepared yellow toner particles were blended with 1.5 wt. parts of Hydrophobic titanium oxide fine powder A to prepare Yellow toner No. 1 wherein the hydrophobic titanium oxide fine particles were carried on the toner particles surfaces.

Yellow toner No. 1 showed $G'_{180}/G'_{min(120\text{-}170)}$=3.1, a softening temperature (Tm)=97° C., and the independent particles (including primary particles and secondary particles) of the yellow colorant exhibited a number-average particle size (Dav)=0.38 $\mu$m. Further, the yellow colorant particles included 78% by number of particles of 0.1–0.5 $\mu$m, and 1.2% by number of particles of 0.8 $\mu$m or larger. Yellow toner No. 1 provided a temperature-dependent storage modulus curve as shown in FIG. 1.

The above-prepared Yellow toner No. 1 and silicone resin-coated magnetic ferrite carrier (having an average particle size ($D_{50}$)=40 $\mu$m) were blended so as to provide a toner concentration of 6 wt. %, thereby providing a two-component type yellow developer.

The above-prepared two-component type yellow developer was charged in a plain paper full-color copying machine ("Color Laser Copying Machine CLC-700", mfd. by Canon K.K.) equipped with a hot-pressure fixing device to effect a copying test at a fixing temperature of 170° C. As a result of a continuous image forming test on 50,000 sheets in a normal temperature/normal humidity environment (temperature: 23° C./humidity: 60% RH), the resultant images showed a high image density of 1.7–1.8. Yellow toner No.1 showed little change in initial chargeability and a stable chargeability in a range of ca. −22 mC/kg to ca. −25 mC/kg.

The OPC photosensitive drum surface after the 50,000 sheets of continuous image formation exhibited no filming of melt-stack toner, and no cleaning failure occurred during the continuous image formation.

During the continuous image formation on 50,000 sheets, no offset onto the heating roller (fixing roller) occurred at all. As a result of visual observation with eyes of the heating roller surface after the continuous image formation, no soiling with the yellow toner was observed.

As a result of observation of the carrier surface through a SEM (scanning electron microscope), almost no attachment of spent toner was observed.

Further, continuous image formation tests each on 50,000 sheets were performed in a high temperature/high humidity (30° C./80% RH) environment and in a low temperature/low humidity (15° C./10% RH) environment, whereby good images were formed at stable image densities and without fog or scattering.

Separately, cyan toner particles having a weight-average particle size of 6.5 $\mu$m and magenta toner particles having a weight-average particle size of 6.3 $\mu$m were in the substantially same manner as the above-mentioned production of the yellow toner particles except for using 4 wt. parts of a cyan pigment (C.I. Pigment Blue 15:3) and 5 wt. parts of a magenta pigment (C.I. Pigment Red 122), respectively, instead of the yellow pigment.

The thus-obtained cyan toner particles and magenta toner particles respectively in 100 wt. parts were blended with 1.5 wt. parts of Hydrophobic titanium oxide fine powder A similarly as in the production of Yellow toner No. 1 to obtain a cyan toner and a yellow toner, respectively, containing the fine particles of Hydrophobic titanium oxide fine powder A carried on the surfaces of the toner particles, which were further similarly formulated into a two-component type cyan developer and a two-component type magenta developer.

Solid image formation was performed by using the developers while adjusting a contrast of the full-color copying mach so as to provide a non-fixed toner coverage of 0.8 mg/cm$^2$ on a transfer-receiving material for each of the yellow toner, magenta toner and cyan, thereby forming a green solid image with the yellow toner and the cyan toner, and a red solid image with the yellow toner and the magenta toner.

As a method for evaluation of color copied images, a gloss of an image surface and a chromaticity of the image are often measured for evaluating the quality of the color image. A higher gloss value is judged to represent a glossy image having a higher surface smoothness and a higher saturation (C*), and a lower gloss value is judge to represent a somber image having a lower saturation (C*) and a rougher surface. Now, "C*" is a value calculated according to the following formula from values of a* and b* measured according to methods described below:

$$C^*=[(a^*)^2+(b^*)^2]^{1/2}.$$

A higher C* represents a clearer image.

The gloss measurement may be performed by using a gloss meter ("VG-10", available from Nippon Denshoku K.K.). For the measurement, a constant voltage of 6 volts is set by a constant voltage supply, the incident and exit angles are respectively set at 60 deg., and a standard adjustment was performed by using a 0-point adjuster and a standard plate. Thereafter, three sheets of white paper are superposed on a sample support and image is placed thereon to effect the measurement by reading a % value indicated on the meter.

Toner colors may be quantitatively measured according to the color space standardized by CIE in 1976. Three indices including a* and b* (chromaticities representing a hue and a saturation) and L* (lightness) are measured. The measurement may be performed by using a spectral calorimeter ("Type 938", available from X-Rite Co.), a C-light source as a light source for observation and a viewing angle of 2 deg.

According to the above-described measurement, the above-prepared respective color images exhibited gloss and color indices shown in the following Table 1.

TABLE 1

| Color images | Toner coverage | gloss | L* | a* | b* |
|---|---|---|---|---|---|
| yellow | 0.8 (mg/cm$^2$) | 19 (%) | 88 | −15 | 96 |
| cyan | 0.8 | 18 | 51 | −20 | −48 |
| magenta | 0.8 | 17 | 49 | 72 | −21 |
| green | 1.6 | 27 | 45 | −60 | 19 |
| red | 1.6 | 27 | 46 | 58 | 32 |

As shown in Table 1 above, Yellow toner No. 1 also provided images of secondary colors of green and red, having high lightness and saturation.

Further, a color image formed by using the above yellow toner on a transparency film was projected by an overhead projector (OHP), whereby a good transparency of the OHP image was exhibited. More specifically, the transparency of the OHP image was evaluated according to the following standard:

A (good): Excellent transparency, free from bright-dark irregularity and excellent color reproducibility.

B (fair): Some bright-dark irregularity was present but was at a practically acceptable level.

C (not acceptable): Bright-dark irregularity was present and the color reproducibility was poor.

A resultant solid image (image density=1.70) was examined with respect to light-fastness substantially according to JIS K7102, whereby an image after 400 hours of illumination with light from a carbon arc lamp showed an image density of 1.63 substantially identical to that of the initial image and indicated substantially no color change as represented by ΔE=3.6 calculated by the following equation:

$$\Delta E=\{(L1^*-L2^*)^2+(a1^*-a2^*)^2+(b1^*-b2^*)^2\}^{1/2},$$

wherein L1*, a1* and b1* denote three color indices before the illumination, and L2*, a2* and b2* denote three color indices after the illumination.

A light-fastness evaluation may be made according to the following standard:

A: Substantially no change after 400 hours.

B: Substantially no change after 200 hours.

C: Fading observed after 100 hours.

Comparative Example 1

Figure 2:
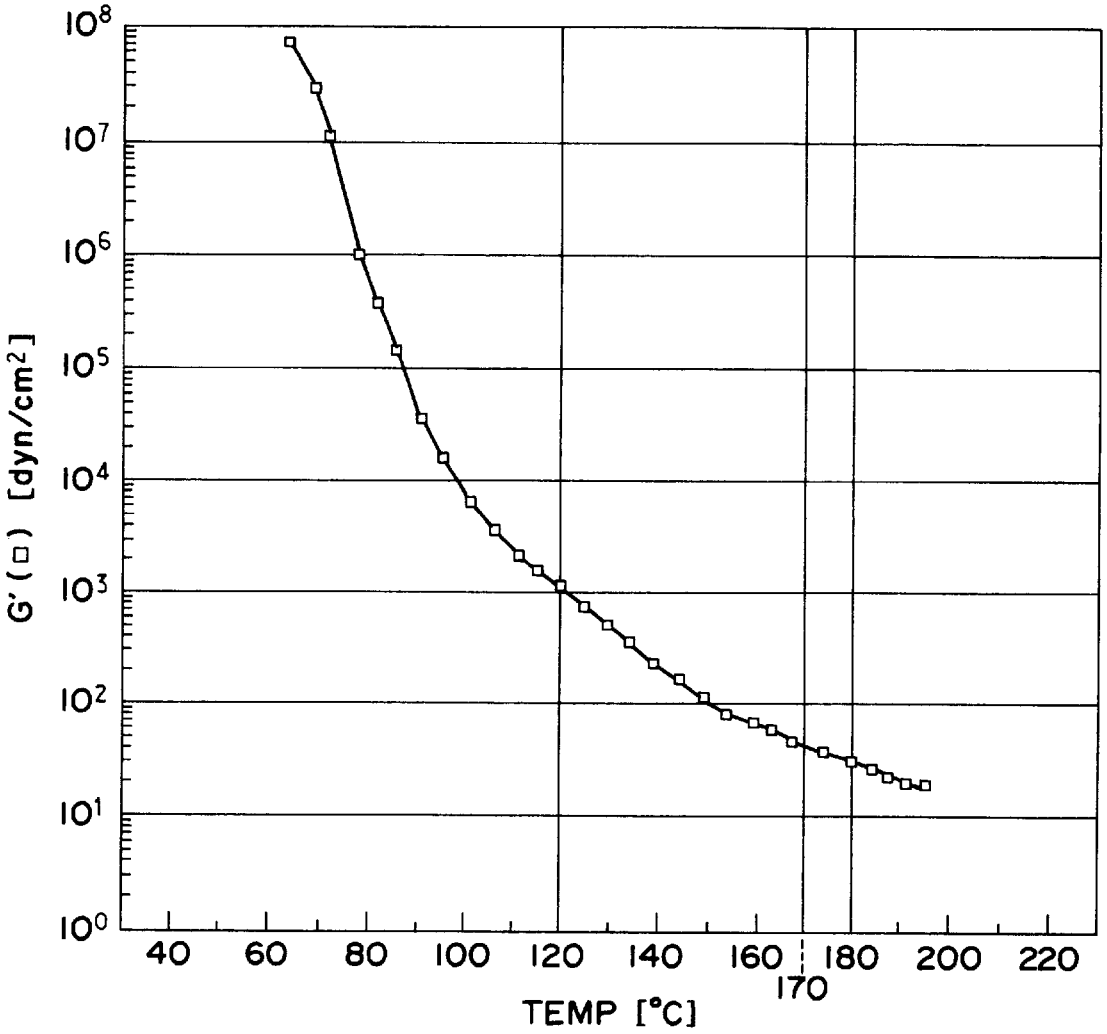
FIG. 2 is a graph showing a storage modulus curve of a conventional yellow toner (Comparative Example 1) having a characteristic of storage modulus monotonously decreasing on temperature increase.

Comparative yellow toner No. 1 was prepared in the same manner as in Example 1 except that the di-tert-butylsalicylic acid aluminum compound was not used. Comparative yellow toner No. 1 exhibit $G'_{180}/G'_{min(120\text{-}170)}$=0.75 and Tm=91° C. Comparative yellow toner No. 1 provided a temperature-dependent storage modulus curve as shown in FIG. 2.

As a result of continuous image formation test in the same manner as in Example 1, the images formed on ca. 3000 sheets and thereafter in the low temperature/low humidity environment began to cause an image density lowering and slight fog.

In the high temperature/high humidity environment, Comparative yellow toner No. 1 caused a lowering in chargeability, and correspondingly the resultant images exhibited an increase in image density and were accompanied with slight scattering and fog.

In the continuous image formation test performed in the normal temperature/normal humidity environment, from ca. 5000 sheets, an offset partially occurred. Accordingly, the continuous image formation test was interrupted to examine the fixing roller, whereby the fixing roller was found to be soiled with the toner.

The gloss and color indices of Comparative yellow toner No. 1 were measured in the same manner as in Example 1. The results are inclusively shown in Tables 2 and 3 appearing hereinafter together with those of Example 1 and other Examples and Comparative Examples described hereinbelow.

As a brief evaluation, Comparative yellow toner No. 1, compared with Yellow toner No. 1 of Example 1, exhibited a lower softening point and exhibited lower brightness and saturation in spite of a higher gloss value under the same fixing conditions. This is presumably attributable to a poor dispersion of the colorant.

OHP images exhibited a transparency which could not be said to be necessarily good.

Comparative Example 2

Comparative yellow toner No. 2 was prepared in the same manner as in Example 1 except for replacing Polyester resin No. 1 with Polyester resin No. 2 [a non-crosslinked polyester resin formed from polyoxypropylene (2.2)-2,2-bis(4-hydroxyphenyl)propane and fumaric acid; AV=12 mgKOH/g, Tg=56° C., Mn=4000, Mw=11000, Tm=90° C.]. Comparative yellow toner No. 2 exhibited $G'_{180}/G'_{min(120\text{-}170)}$=0.98 and Tm=93° C.

The comparative yellow toner did not cause particular problem in the continuous image formation test in the normal temperature/normal humidity environment, but caused a lower chargeability leading to fog in the continuous image formation in the high temperature/high humidity environment. Further, as a result of examination of the fixing roller after 20,000 sheets of continuous image formation, the fixing roller was soiled with the yellow toner.

Comparative Example 3

Comparative yellow toner No. 3 was prepared in the same manner as in Example 1 except for replacing Polyester resin No. 1 with Polyester resin No. 2 [a crosslinked polyester resin formed from polyoxypropylene (2.2)-2,2-bis(4-hydroxyphenyl)propane, terephthalic acid, fumaric acid and trimellitic acid; AV=15 mgKOH/g, Tg=59° C., Mn=5600, Mw=22000, Tm=98° C.], and using 8 wt. parts of di-tert-butylsalicylic acid aluminum compound. Comparative yellow toner No. 3 exhibited $G'_{180}/G'_{min(120\text{-}170)}$=8.8 and Tm=116° C.

Comparative yellow toner No. 3 provided images which exhibited a lower gloss but were free from fog and exhibited a good halftone reproducibility. In the continuous image formation in the low temperature/low humidity environment, a cold offset phenomenon occurred on the 30th sheet, so that the continuous image formation test was interrupted. Further, the resultant OHP images were not necessarily good.

Compared with yellow toner No. 1 in Example 1, Comparative yellow toner No. 3 exhibited a higher softening point, so that the resultant images obtained under the same fixing conditions exhibited a lower gloss and also lower lightness and saturation, thus failing to provide clear yellow images.

Comparative Example 4

Comparative yellow toner No. 4 was prepared in the same manner as in Example 1 except for replacing Polyester resin No. 1 with a styrene/acrylic resin [a copolymer of styrene and n-butyl acrylate; AV=ca. 0, Tg=60° C., Mn=4800, Mw=1500, Tm=96° C.].

Comparative yellow toner No. 4 exhibited lower brightness and saturation than Yellow toner No. 1 of Example 1.

In the continuous image formation test in the low temperature/low humidity environment, Comparative yellow toner No. 4 caused an increase in chargeability to result in low-density images, to that the continuous image formation test was interrupted.

Comparative Example 5

Comparative yellow toner No. 5 was prepared in the same manner as in Example 1 except that the yellow colorant was replaced by C.I. Pigment 180 [Dav.=0.38 μm, $R_{L/B}$=1.8, and $S_{BET}$=39 $m^2/g$]. Comparative yellow toner No. 5 exhibited $G'_{180}/G'_{min(120\text{-}170)}$=28, Tm=96° C., and the independent particles (including primary particles and secondary particles) of the yellow colorant dispersed in the toner particles exhibited a number-average particle size (Dav.) of 0.58 μm. Further, the yellow colorant particles included 38% by number of particles of 0.1–0.5 μm and 8% by number of particles of 0.8 μm or larger.

Comparative yellow toner No. 5 exhibited lightness and saturation which were both lower than those of Yellow toner No. 1 of Example 1. Comparative yellow toner No. 5 was used in combination with the cyan toner prepared in Example 1 to form a solid green image, which exhibited a gloss of 27%, L*=44, a*=−52 and b*=17 and was thus found to have a lower saturation.

When subjected to the continuous image formation in the low temperature/low humidity environment, Comparative yellow toner No. 5 caused an image density lowering due to an increase in chargeability.

Comparative Example 6

Comparative yellow toner No. 6 was prepared and evaluated in the same manner as in Example 1 except for replacing the yellow colorant with 7 wt. parts of a yellow colorant of the following formula (4).
(C.I. Pigment Yellow 74)

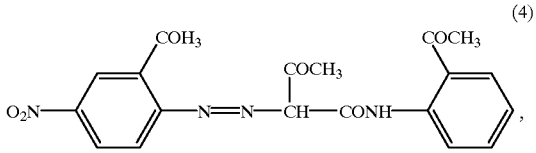

per 100 wt. parts of the polyester resin.

As a result, in the continuous image formation in the high temperature/high humidity environment, Comparative yellow toner No. 6 caused a lowering in charge to result in images with noticeable fog from ca. 5000th sheet and so on, so that the continuous image formation was interrupted.

Compared with the compound of Formula (1) used in Example 1, the yellow colorant of the formula (4) exhibited a lower coloring power, so that the contrast potential of the full-color copying machine had to be increased than in Example 1 in order to provide high-density images.

Comparative Example 7

Comparative yellow toner No. 7 was prepared and evaluated in the same manner as in Example 1 except for replacing the yellow colorant with 5 wt. parts of a yellow colorant of the following formula (5).
(C.I. Pigment Yellow 12)

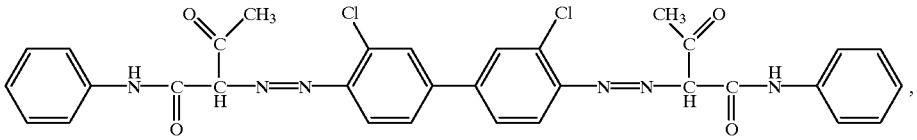

(5)

per 100 wt. parts of the polyester resin.

In each environment, continuous image was performed generally stably. When the resultant yellow images were subjected to an accelerated light-fastness test by exposure to a carbon arc lamp, however, the images resulted in ΔE=12 after the exposure for 100 hours, thus indicating a substantial fading.

EXAMPLE 2

Yellow toner No. 2 was prepared in the same manner as in Example 1 except for replacing Polyester resin No. 1 with Polyester resin No. 4 [a crosslinked polyester resin formed from polyoxypropylene(2.2)-2,2-bi(4-hydroxyphenyl) propane, terephthalic acid, fumaric acid and trimellitic acid; AV=2.4 mgKOH/g, Tg=59° C., Mn=4200, Mw=12000, Tm=95° C.]. As a result of evaluation in the same manner as in Example 1, Yellow toner No. 2 began to result in images with a lower image density from ca. 20000-th sheet during the continuous image formation in the two temperature/low humidity environment, but it was within a practically acceptable level.

Yellow toner No. 2 exhibited $G'_{180}/G'_{min(120\text{-}170)}$=2.1 and Tm=100° C.

EXAMPLE 3

Yellow toner No. 3 was prepared in the same manner as in Example 1 except for replacing Polyester resin No. 1 with Polyester resin No. 5 [a crosslinked polyester resin formed from polyoxypropylene(2.2)-2,2-bi(4-hydroxyphenyl) propane, terephthalic acid, fumaric acid and trimellitic acid; AV=24.2 mgKOH/g, Tg=54° C., Mn=4800, Mw=11000, Tm=92° C.]. As a result of evaluation in the same manner as in Example 1, Yellow toner No. 3 caused a slight lowering in chargeability in the high temperature/high humidity environment, which however did not lead to any substantial image defects.

Yellow toner No. 3 exhibited $G'_{180}/G'_{min(120\text{-}170)}$=3.4 and Tm=99° C.

EXAMPLE 4

Yellow toner No. 4 was prepared and evaluated in the same manner as in Example 1 except for replacing Hydrophobic titanium oxide fine powder A with Hydrophobic aluminum oxide fine powder A (having Dav-1=0.02 μm and hydrophobicity of 70% and formed by surface-treating 100 wt. parts of hydrophillic alumina fine powder (Dav-1=0.02 μm, $S_{BET}$=130 $m^2/g$) with 17 wt. parts of iso-$C_4H_9$—Si $(OCH_3)_3$).

As a result, Yellow toner No. 4 exhibited good continuous image forming performances in the respective environments and similar tendencies with respect to light-fastness and color indices as Yellow toner No. 1 of Example 1.

EXAMPLE 5

Yellow toner No. 5 was prepared and evaluated and evaluated in the same manner as in Example 1 except for replacing the di-tert-butylsalicylic acid aluminum compound with di-tert-butylsalicylic acid zinc compound. Yellow toner No. 5 exhibited $G'_{180}/G'_{min(120\text{-}170)}$=2.0 and Tm=93° C.

Yellow toner No. 5 resulted in yellow images which exhibited slightly lower lightness and saturation within a practically acceptable level. In the continuous image formation test in the low temperature/low humidity environment, the resultant images were good up to 20,00 sheets but, from a point of time after ca. 20,000 sheets, the resultant images caused a lowering in image density and were accompanied with fog and rough halftone portions.

In the continuous image formation test in the high temperature/high humidity environment, the resultant images were slightly foggy from the initial stage but were within a practically acceptable level.

TABLE 2

| Example or Comparative Example | Yellow toner Name | $G'_{180}/G'_{min(120\text{-}170)}$ | Tm (° C.) | Dav. (μm) | Yellow pigments dispersed in toner particles: Particles of 0.1–0.5 μm (% by number) | Particles of ≧0.8 μm (% by number) |
|---|---|---|---|---|---|---|
| Ex. 1 | No. 1 | 3.1 | 97 | 0.38 | 78 | 1.2 |
| Comp. Ex. 1 | Comp. No. 1 | 0.75 | 91 | 0.62 | 33 | 25 |

TABLE 2-continued

| Example or Comparative Example | Yellow toner Name | $G'_{180}/G'_{min(120-170)}$ | Tm (° C.) | Dav. (μm) | Yellow pigments dispersed in toner particles: Particles of 0.1–0.5 μm (% by number) | Particles of ≧0.8 μm (% by number) |
|---|---|---|---|---|---|---|
| Comp. Ex. 2 | Comp. No. 2 | 0.98 | 93 | 0.51 | 58 | 12 |
| Comp. Ex. 3 | Comp. No. 3 | 8.8 | 116 | 0.35 | 82 | 0 |
| Comp. Ex. 4 | Comp. No. 4 | 0.95 | 98 | 0.72 | 15 | 43 |
| Comp. Ex. 5 | Comp. No. 5 | 2.8 | 96 | 0.58 | 38 | 8 |
| Comp. Ex. 6 | Comp. No. 6 | 2.9 | 97 | 0.47 | 59 | 6.3 |
| Comp. Ex. 7 | Comp. No. 7 | 3.0 | 97 | 0.42 | 79 | 0 |
| Ex. 2 | No. 2 | 2.1 | 100 | 0.42 | 73 | 2.4 |
| Ex. 3 | No. 3 | 3.4 | 99 | 0.39 | 79 | 1.0 |
| Ex. 4 | No. 4 | 3.1 | 97 | 0.38 | 78 | 1.2 |
| Ex. 5 | No. 5 | 2.0 | 93 | 0.49 | 63 | 9.5 |

TABLE 3

| | | Toner weight (mg/cm²) | Gloss (%) | L* | a* | b* | Transparency** | Chargeability (23° C., 60% RH) (mC/kg) | Light-fastness |
|---|---|---|---|---|---|---|---|---|---|
| Ex. 1 | Yellow image | 0.8 | 19 | 88 | −15 | 96 | A | −22 to −25 | A |
| Comp. Ex. 1 | " | 0.8 | 29 | 86 | −16 | 90 | C | −19 to −29 | A |
| Comp. Ex. 2 | " | 0.8 | 6 | 84 | −16 | 88 | C | −20 to −23 | A |
| Comp. Ex. 3 | " | 0.8 | 12 | 86 | −16 | 85 | C | −22 to −25 | A |
| Comp. Ex. 4 | " | 0.8 | 22 | 85 | −15 | 88 | C | −19 to −26 | A |
| Comp. Ex. 5 | " | 0.8 | 21 | 86 | −16 | 90 | B | −21 to −25 | A |
| Comp. Ex. 6 | " | 0.8 | 20 | 85 | −5 | 90 | B | −18 to −25 | B |
| Comp. Ex. 7 | " | 0.8 | 20 | 86 | −17 | 90 | B | −20 to −25 | C |
| Ex. 2 | " | 0.8 | 20 | 87 | −15 | 94 | A | −22 to −26 | A |
| Ex. 3 | " | 0.8 | 18 | 87 | −15 | 95 | A | −21 to −24 | A |
| Ex. 4 | " | 0.8 | 20 | 88 | −15 | 96 | A | −22 to −25 | A |
| Ex. 5 | " | 0.8 | 24 | 86 | −16 | 91 | A | −22 to −27 | A |

**Transparency of OHP images.

EXAMPLE 6

| | |
|---|---|
| Polyester resin No. 6 | 70 wt. parts |

[a crosslinked polyester resin formed from polyoxyethylene(2)-2,2-bis(4-hydroxyphenyl)propane, terephthalic acid, fumaric acid and trimellitic acid; AV=10.3 mgKOH/g, Tg=56° C., Mn=3900, Mw=12700, Tm=90° C.]

| | |
|---|---|
| Yellow colorant (pigment) of Formula (1) | 30 wt. parts |

[Dav.=0.28 μm, $R_{L/B}$=1.3, $S_{BET}$=77 m²/g]

The above polyester resin and yellow colorant were charged in a kneader-type mixer and were sufficiently premixed under no pressure but with mixing and heating. Then, the premix was kneaded twice on a three-roll mill to obtain a first kneaded product (containing 30 wt. % of pigment particles).

| | |
|---|---|
| First kneaded product | 16.7 wt. parts |
| Polyester resin No. 6 | 88.3 wt. parts |
| Di-tert-butylsalicylic acid, aluminum compound | 4 wt. parts |

The above ingredients were sufficiently and melt-kneaded through a twin-screw extruder, followed by cooling, crushing by a hammer mill into sizes of ca. 1–2 mm and fine pulverization by means of an air jet-type pulverizer. From the fine pulverizate, a fine powder fraction and a coarse powder fraction were strictly removed to recover yellow toner particles having a weight-average particle size ($D_4$) of 6.5 μm.

Separately, 100 wt. parts of hydrophillic titanium oxide fine powder Dav-1=0.005 μm, $S_{BET}$=250 m²/g) was surface-treated with 30 wt. parts of iso-$C_4H_9$—$Si(OCH_3)_3$ to obtain Hydrophobic alumina fine powder B (Dav-1=0.005 μm, hydrophobicity (HP)=70%).

100 wt. parts of the above prepared yellow toner particles were blended with 1.2 wt. parts of Hydrophobic alumina fine powder B to prepare Yellow toner No. 6 wherein the hydrophobic alumina fine particles were carried on the toner particles surfaces.

The above-prepared Yellow toner No. 6 and silicone resin-coated magnetic ferrite carrier (having an average particle size ($D_{50}$)=40 μm) were blended so as to provide a toner concentration of 6 wt. %, thereby providing a two-component type yellow developer.

The above-prepared two-component type yellow developer was charged in a plain paper full-color copying machine ("Color Laser Copying Machine CLC-700", mfd. by Canon K.K.) equipped with a hot-pressure fixing device to effect a copying test. As a result of a continuous image forming test on 50,000 sheets in a normal temperature/normal humidity environment (temperature: 23° C./humidity: 60% RH), the resultant images showed a high image density of 1.7–1.8. Yellow toner No. 6 showed little change in initial chargeability and a stable chargeability in a range of ca. −23 mC/kg to ca. −26 mC/kg.

The photosensitive drum surface after the 50,000 sheets of continuous image formation exhibited no filming of melt-stack toner, and no cleaning failure occurred during the continuous image formation.

During the continuous image formation on 50,000 sheets, no offset onto the heating roller (fixing roller) occurred at all. As a result of visual observation with eyes of the heating roller surface after the continuous image formation, no soiling with the yellow toner was observed.

As a result of observation of the carrier surface through a SEM (scanning electron microscope), almost no attachment of spent toner was observed.

Further, continuous image formation tests each on 50,000 sheets were performed in a high temperature/high humidity (30° C./80% RH) environment and in a low temperature/low humidity (15° C./10% RH) environment, whereby good images were formed at stable image densities and without fog or scattering.

Separately, cyan toner particles having a weight-average particle size of 6.5 μm and magenta toner particles having a weight-average particle size of 6.3 μm were in the substantially same manner as the above-mentioned production of the yellow toner particles except for using 4 wt. parts of a cyan pigment (C.I. Pigment Blue 15:3) and 5 wt. parts of a magenta pigment (C.I. Pigment Red 122), respectively, instead of the yellow pigment.

The thus-obtained cyan toner particles and magenta toner particles respectively in 100 wt. parts were blended with 1.2 wt. parts of Hydrophobic alumina fine powder B similarly as in the production of Yellow toner No. 6 to obtain a cyan toner and a yellow toner, respectively, containing the fine particles of Hydrophobic alumina fine powder B carried on the surfaces of the toner particles, which were further similarly formulated into a two-component type cyan developer and a two- component type magnetic developer.

Solid image formation was performed by using the developers while adjusting a contrast of the full-color copying mach so as to provide a non-fixed toner coverage of 0.8 mg/cm$^2$ on a transfer-receiving material for each of the yellow toner, magenta toner and cyan, thereby forming a green solid image with the yellow toner and the cyan toner, and a red solid image with the yellow toner and the magenta toner.

The thus-prepared respective color images exhibited gloss and color indices shown in the following Table 4.

TABLE 4

| Color images | Toner coverage | gloss | L* | a* | b* |
|---|---|---|---|---|---|
| yellow | 0.8 (mg/cm$^2$) | 20 (%) | 90 | −16 | 99 |
| cyan | 0.8 | 19 | 52 | −20 | −48 |
| magenta | 0.8 | 20 | 50 | 72 | −21 |

TABLE 4-continued

| Color images | Toner coverage | gloss | L* | a* | b* |
|---|---|---|---|---|---|
| green | 1.6 | 27 | 45 | −65 | 25 |
| red | 1.6 | 27 | 46 | 58 | 32 |

As shown in Table 4 above, Yellow toner No. 6 also provided images of secondary colors of green and red, having high lightness and saturation.

Further, a color image formed by using the above yellow toner on a transparency film was projected by an overhead projector (OHP), whereby a good transparency of the OHP image was exhibited.

The evaluation results are inclusively shown in Tables 6 and 7 appearing hereinafter together with those obtained in Examples and Comparative Examples described hereinafter.

Comparative Example 8

Comparative yellow toner No. 8 (of $D_4$=6.6 μm) was prepared in the same manner as in Example 6 except that the yellow colorant was replaced by a yellow colorant of the same Formula (1) (but Dav.=0.42 μm, $R_{L/B}$=2.1, $S_{BET}$=3.6 m$^2$/g).

As a result of evaluation in the same manner as in Example 6, Comparative yellow toner No. 8 showed a slightly higher chargeability (in terms of an absolute value) than but substantially the same continuous image forming performances as Yellow Toner No. 6 of Example 6. During the continuous image formation, the comparative toner exhibited chargeabilities of −27 to −30 mC/kg and provided images of relatively stable image densities.

However, the resultant yellow images were slightly reddish in tint as a whole and could not be evaluated as suitable as a yellow toner for full-color image formation. Further, Comparative yellow toner No. 1 provided OHP images showing a transparency inferior than obtained by using Yellow toner No. 6 of Example 6.

As a result of evaluation in the same manner as in Example 6, Comparative yellow toner No. 8 provided yellow images and green images exhibiting gloss and color indices shown in the following Table 5.

TABLE 5

| Color images | Toner coverage | gloss | L* | a* | b* |
|---|---|---|---|---|---|
| yellow | 0.8 (mg/cm$^2$) | 20 (%) | 86 | −13 | 92 |
| green | 1.6 | 27 | 42 | −52 | 26 |

Comparative Example 9

Comparative yellow toner No. 9 was prepared in the same manner as in Example 6 except that the di-tert-butylsalicylic acid aluminum compound was not used.

As a result of continuous image formation test in the same manner as in Example 6, the images formed on ca. 3000 sheets and thereafter in the low temperature/low humidity environment began to cause an image density lowering are slight fog.

In the high temperature/high humidity environment, Comparative yellow toner No. 9 exhibited a lower chargeability and correspondingly the resultant images were accompanied with scattering and fog, so that the continuous image formation test was interrupted.

In the continuous image formation test performed in the normal temperature/normal humidity environment, from ca. 5000 sheets, an offset partially occurred. Accordingly, the continuous image formation test was interrupted to examine the fixing roller, whereby the fixing roller was found to be soiled with the toner.

Compared with Yellow toner No. 6 of Example 6, Comparative yellow toner No. 9 exhibited a slightly lower softening point leading to a higher gloss value but exhibited lower lightness and saturation under the same fixing conditions. This is presumably attributable to a poor dispersion of the colorant.

OHP images exhibited a transparency which could not be said to be necessarily good.

Comparative Example 10

Comparative yellow toner No. 10 was prepared in the same manner as in Example 6 except for replacing Polyester resin No. 6 with Polyester resin No. 7 [a crosslinked polyester resin formed from polyoxypropylene(2.2)-2,2-bis (4-hydroxyphenyl)propane, terephthalic acid, fumaric acid and trimellitic acid; AV=1.9 mgKOH/g, Tg=59° C., Mn=4100, Mw=12000, Tm=93° C.].

As a result of evaluation in the same manner as in Example 6, Comparative yellow toner No. 10 began to result in rough images having a lower image density from ca. 10,000-th sheet and foggy images on further continuation of image formation during the continuous image formation during the continuous image formation in the low temperature/low humidity environment. OHP images obtained in the initial images exhibited a lower transparency than that obtained from Yellow toner No. 6 of Example 6.

Comparative Example 11

Comparative yellow toner No. 11 ($D_4$=6.5 μm) was prepared in the same manner as in Example 6 except for replacing Polyester resin No. 6 with Polyester resin No. 8 [a crosslinked polyester resin formed from polyoxypropylene (2.2)-2,2-bis(4-hydroxyphenyl)propane, terephthalic acid, fumaric acid and trimellitic acid; AV=26.3 mgKOH/g, Tg=55° C., Mn=4800, Mw=11000, Tm=93° C.].

As a result of evaluation in the same manner as in Example 6, Comparative yellow toner No. 11 exhibited a lower chargeability and resulted in toner scattering on continuation of image formation in the low temperature/low humidity environment.

Comparative Example 12

Comparative yellow toner No. 12 ($D_4$=6.8 μm) was prepared in the same manner as in Example 6 except for replacing Polyester resin No. 6 with Polyester resin No. 9 [a non-crosslinked polyester resin formed from polyoxypropylene(2.2)-2,2-bis(4-hydroxyphenyl)propane, fumaric acid and alkenylsuccinic acid; AV=9.8 mgKOH/g, Tg=49° C., Mn=3200, Mw=10200, Tm=86° C.].

As a result of evaluation in the same manner as in Example 6, winding about the fixing roller of transfer paper carrying the fixed images occurred after ca. 100 sheets during image formation in the normal temperature/normal humidity environment, so that the continuous image formation was interrupted.

Comparative Example 13

Comparative yellow toner No. 13 ($D_4$=6.7 μm) was prepared in the same manner as in Example 6 except for replacing Polyester resin No. 6 with Polyester resin No. 10 [a non-crosslinked polyester resin formed from polyoxypropylene(2.2)-2,2-bis(4-hydroxyphenyl)propane, isophthalic acid, terephthalic acid and maleic anhydride; AV=10.7 mgKOH/g, Tg=69° C., Mn=5400, Mw=23300, Tm=110° C.].

As a result of evaluation in the same manner as in Example 6, in the continuous image formation in the normal temperature/normal humidity environment, Comparative yellow toner No. 13 exhibited a good toner chargeability in the initial stage, but the resultant images exhibited a low gloss and remarkably lower saturation and brightness than those obtained by using Yellow toner No. 6 of Example 6. Further, as a result of image formation in the low temperature/low humidity environment, cold offset phenomenon occurred on 15th sheet, so that the continuous image formation was interrupted.

EXAMPLE 7

Yellow toner particles of $D_4$=8.5 μm were prepared in the same manner as in Example 6 except that the yellow colorant was replaced by a yellow colorant of Formula (1) (Dav.=0.26 μm, $R_{L/B}$=1.5, $S_{BET}$=72 $m^2/g$). Then, 100 wt. parts of the yellow toner particles were blended with 1.0 wt. part of Hydrophobic alumina fine powder B used in Example 6 to prepare Yellow toner No. 7, which was then evaluated in the same manner as in Example 6. The results are shown in Tables 6 and 7.

EXAMPLE 8

Yellow toner No. 8 was prepared and evaluated in the same manner as in Example 6 except for replacing Hydrophobic alumina fine powder B with Hydrophobic alumina fine powder C (having Dav-1=0.02 μm and hydrophobicity of 70% and formed by surface-treating 100 wt. parts of hydrophillic alumina fine powder (Dav-1=0.02 μm, $S_{BET}$= 130 $m^2/g$) with 17 wt. parts of iso-$C_4H_9$—$Si(OCH_3)_3$).

As a result, Yellow toner No. 8 exhibited good continuous image forming performances in the respective environments and similar tendencies with respect to light-fastness and color indices as Yellow toner No. 6 of Example 6.

EXAMPLE 9

Yellow toner No. 9 was prepared and evaluated in the same manner as in Example 6 except for replacing Hydrophobic alumina fine powder B with Hydrophobic titanium oxide fine powder B (having Dav-1=0.05 μm and hydrophobicity of 70% and formed by surface-treating 100 wt. parts of hydrophillic titanium oxide fine powder (Dav-1= 0.05 μm, $S_{BET}$=140 $m^2/g$) with 17 wt. parts of n-$C_4H_9$—Si $(OCH_3)_3$).

As a result, Yellow toner No. 9 exhibited good continuous image forming performances in the respective environments and similar tendencies with respect to light-fastness and color indices as Yellow toner No. 6 of Example 6.

EXAMPLE 10

Yellow toner No. 10 was prepared and evaluated in the same manner as in Example 6 except for replacing Hydrophobic alumina fine powder B with hydrophillic titanium oxide fine powder (Dav-1=0.05 μm, $S_{BET}$=140 $m^2/g$) without a surface treatment.

Yellow toner No. 10 exhibited a low chargeability of −16 mC/kg in the initial stage in the high temperature/high humidity environment, which was at the lowest level allowing a continuous image formation. On continuation of the continuous image formation in the same environment, the resultant images included rough halftone portions but were within a practically acceptable level. However, after standing for one day after the image formation, the toner exhibited a lower chargeability by ca. 3 mC/kg (absolute value) compared with that before the standing.

EXAMPLE 11

Yellow toner No. 11 was prepared and evaluated in the same manner as in Example 6 except for replacing Hydrophobic alumina fine powder B with hydrophobic silica fine powder (Dav-1=0.007 $\mu$m, hydrophobicity=65%) formed by surface-treating 100 wt. parts of hydrophillic silica fine powder (Dav-1=0.007 $\mu$m, $S_{BET}$=380 $m^2/g$) with 20 wt. parts of hexamethyldisilazane. The toner began to exhibit an increased charge after ca. 2000th sheet in the continuous image formation in the low temperature/low humidity environment, thus resulting in a lower image density.

TABLE 6

| Example or Comparative Example | Yellow toner: Name | $G'_{180}/G'_{min(120-170)}$ | Tm (° C.) | Yellow pigments dispersed in toner particles: Dav. (um) | Particles of 0.1–0.5 um (% by number) | Particles of ≧0.8 um (% by number) |
|---|---|---|---|---|---|---|
| Ex. 6 | No. 6 | 2.6 | 98 | 0.30 | 84 | 0 |
| Comp. Ex. 8 | Comp. No. 8 | 2.5 | 97 | 0.62 | 24 | 27.0 |
| Comp. Ex. 9 | Comp. No. 9 | 0.8 | 92 | 0.58 | 34 | 18.0 |
| Comp. Ex. 10 | Comp. No. 10 | 1.9 | 97 | 0.39 | 62 | 8.0 |
| Comp. Ex. 11 | Comp. No. 11 | 3.2 | 103 | 0.32 | 80 | 2.3 |
| Comp. Ex. 12 | Comp. No. 12 | 0.8 | 87 | 0.50 | 42 | 21.7 |
| Comp. Ex. 13 | Comp. No. 13 | 0.92 | 116 | 0.35 | 72 | 10.8 |
| Ex. 7 | No. 7 | 2.6 | 98 | 0.31 | 82 | 0 |
| Ex. 8 | No. 8 | 2.6 | 98 | 0.30 | 84 | 0 |
| Ex. 9 | No. 9 | 2.6 | 98 | 0.30 | 84 | 0 |
| Ex. 10 | No. 10 | 2.6 | 98 | 0.30 | 84 | 0 |
| Ex. 11 | No. 11 | 2.6 | 98 | 0.30 | 84 | 0 |

TABLE 7

| | | Toner weight ($mg/cm^2$) | Gloss (%) | L* | a* | b* | Transparency** | Chargeability (23° C., 60% RH) (mC/kg) | Lightfastness |
|---|---|---|---|---|---|---|---|---|---|
| Ex. 1 | Yellow image | 0.8 | 20 | 90 | −16 | 99 | A | −23 to −26 | A |
| Comp. Ex. 8 | " | 0.8 | 20 | 86 | −13 | 92 | C | −27 to −30 | A |
| Comp. Ex. 9 | " | 0.8 | 28 | 86 | −16 | 90 | B | −18 to −23 | A |
| Comp. Ex. 10 | " | 0.8 | 19 | 89 | −16 | 93 | B | — | A |
| Comp. Ex. 11 | " | 0.8 | 18 | 88 | −15 | 92 | B | — | A |
| Comp. Ex. 12 | " | 0.8 | 34 | 89 | −18 | 97 | B | — | B |
| Comp. Ex. 13 | " | 0.8 | 5 | 84 | −18 | 80 | C | −23 to −26 | A |
| Ex. 7 | " | 0.8 | 20 | 88 | −16 | 97 | A | −25 to −28 | A |
| Ex. 8 | " | 0.8 | 20 | 90 | −16 | 99 | A | −24 to −27 | A |
| Ex. 9 | " | 0.8 | 21 | 89 | −16 | 98 | A | −23 to −26 | A |
| Ex. 10 | " | 0.8 | 22 | 90 | −17 | 97 | A | −18 to −20 | A |
| Ex. 11 | " | 0.8 | 22 | 89 | −17 | 98 | A | −22 to −29 | A |

**Transparency of OHP images.

What is claimed is:

1. A yellow toner for developing electrostatic images, comprising: yellow toner particles containing a binder resin and a yellow colorant, wherein the yellow toner has a storage modulus $G'_{180}$ at 180° C. and a minimum storage modulus $G'_{min(120-170)}$ in a temperature range of 120–170° C. giving a ratio $[G'_{180}/G'_{min(120-170)}]$ of 2.0–8.0;

the binder resin comprises a polyester resin having a glass transition temperature of 50–65° C. and an acid value of 2.0–25.0 mgKOH/g;

the yellow toner comprises a compound represented by Formula (1) below:

Formula (1):

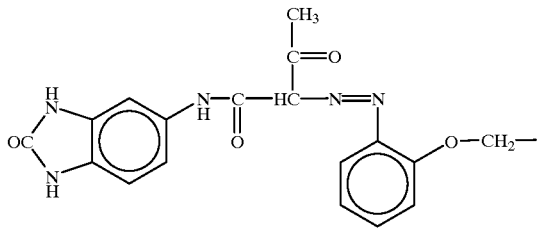

-continued

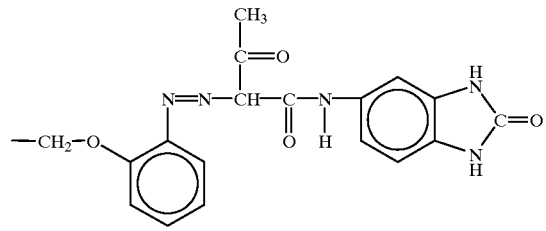

the yellow colorant comprises primary particles giving a length/breadth ratio of at most 1.5; and the yellow colorant is dispersed in the toner particles as independent particles (including primary particles and secondary particles) providing a number-average particle size of 0.1–0.7 μm.

2. The yellow toner according to claim 1, wherein the independent particles of the yellow colorant dispersed in the yellow toner particles include at least 60% by number of particles of 0.1–0.5 μm in particle size, and 0–10% by number of particles of 0.8 μm or larger in particle size.

3. The yellow toner according to claim 2, wherein the independent particles of the yellow colorant dispersed in the yellow toner particles include at least 70% by number of particles of 0.1–0.5 μm.

4. The yellow toner according to claim 2, wherein the independent particles of the yellow colorant dispersed in the yellow toner particles include at least 70% by number of particles of 0.1–0.5 μm.

5. The yellow toner according to claim 1, wherein the yellow toner particles contain a metal compound of an aromatic carboxylic acid.

6. The yellow toner according to claim 5, wherein the aromatic carboxylic acid is an aromatic hydroxycarboxylic acid selected from the group consisting of salicylic acid, monoalkylsalicylic acids and dialkylsalicylic acids.

7. The yellow toner according to claim 5, wherein the aromatic carboxylic acid is di-tert-butylsalicylic acid.

8. The yellow toner according to claim 5, wherein the metal compound of an aromatic carboxylic acid is a metal compound selected from the group consisting of metal salts of salicylic acid, metal complexes of salicylic acid, metal salts of alkylsalicylic acids, metal complexes of alkylsalicylic acids, metal salts of dialkylsalicylic acids and metal complexes of dialkylsalicylic acids.

9. The yellow toner according to claim 5, wherein the metal compound of an aromatic carboxylic acid is an aluminum compound of aromatic hydroxycarboxylic acid.

10. The yellow toner according to claim 5, wherein the metal compound of an aromatic carboxylic acid is an aluminum compound of di-tert-butylsalicylic acid.

11. The yellow toner according to claim 1, wherein the binder resin has a glass transition temperature of 52–65° C.

12. The yellow toner according to claim 1, wherein the binder resin has a glass transition temperature of 53–64° C.

13. The yellow toner according to claim 1, wherein the polyester resin has an acid value of 5–20 mgKOH/g.

14. The yellow toner according to claim 1, wherein the polyester resin is a polyester resin formed from a dihydric alcohol, a dibasic carboxylic acid and a polybasic carboxylic acid of the following formula (3) or an anhydride thereof:

(3)

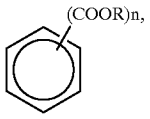

wherein n is an integer of at least 3, and at least 3 groups R independently denote a hydrogen atom, an alkyl group having 1–18 carbon atoms, an alkenyl group having 2–18 carbon atoms, or an aryl group having 6–18 carbon atoms.

15. The yellow toner according to claim 14, wherein the polyester resin has a number-average molecular weight (Mn) of 1,500–50,000, and a weight-average molecular of 6,000–100,000.

16. The yellow toner according to claim 15, wherein the polyester resin has Mn=2,000 to 20,000, and Mw=10,000 to 90,000.

17. The yellow toner according to claim 15, wherein the polyester resin has an Mw/Mn ratio of 2–8.

18. The yellow toner according to claim 1, wherein the yellow toner particles contain 1–15 wt. parts of the yellow colorant per 100 wt. parts of the binder resin.

19. The yellow toner according to claim 1, wherein the yellow toner particles contain 3–12 wt. parts of the yellow colorant per 100 wt. parts of the binder resin.

20. The yellow toner according to claim 1, wherein the yellow toner particles contain 4–10 wt. parts of the yellow colorant per 100 wt. parts of the binder resin.

21. The yellow toner according to claim 1, having a softening point (Tm) of 90–115° C.

22. The yellow toner according to claim 1, wherein the yellow toner particles have a weight-average particle size ($D_4$) of 3–15 μm.

23. The yellow toner according to claim 1, wherein the yellow toner particles have a weight-average particle size ($D_4$) of 4–12 μm.

24. The yellow toner according to claim 1, wherein the yellow toner particles have a weight-average particle size ($D_4$) of 4–8 μm.

25. The yellow toner according to claim 1, wherein the yellow toner particles have a weight-average particle size ($D_4$) of 4–8 μm, and the independent particles of the yellow colorant dispersed in the toner particles include at least 70% by number of particles of 0.1–0.5 μm and 0–5% by number of particles of 0.8 μm or larger.

26. The yellow toner according to claim 21, obtained through melt-kneading and having a softening temperature (Tm) higher by at least 3° C. than that of the polyester resin prior to the melt-kneading.

27. The yellow toner according to claim 26, having a softening point temperature (Tm) higher by at least 4° C. than that of the polyester resin prior to the melt-kneading.

28. The yellow toner according to claim 1, wherein the yellow toner particles are blended with hydrophobized titanium oxide fine powder having an average particle size of 0.005–0.1 μm externally added thereto.

29. The yellow toner according to claim 1, wherein the yellow toner particles are blended with hydrophobized aluminum oxide fine powder having an average particle size of 0.005–0.1 μm externally added thereto.

30. The yellow toner according to claim 1, having a negative chargeability.

31. The yellow toner according to claim 1, wherein the yellow toner particles are yellow-colored resin particles obtained by melt-kneading a mixture comprising at least the polyester resin, the yellow colorant and an aromatic hydroxycarboxylic acid metal compound, cooling the melt-kneaded mixture, and pulverizing the cooled melt-kneaded mixture.

* * * * *

UNITED STATES PATENT AND TRADEMARK OFFICE

CERTIFICATE OF CORRECTION

PATENT NO. : 6,022,659
DATED : February 8, 2000
INVENTOR(S) : Makoto Kanbayashi, et al.

It is certified that error appears in the above-identified patent and that said Letters Patent is hereby corrected as shown below:

Column 1
Line 64, "term" should read -- factor --.

Column 2
Line 1, "term" should read -- factor --.
Line 67, "is" should read -- are --.

Column 3
Line 16, "image" should read -- images --.
Line 32, "product" should read -- product and --.

Column 4
Line 5, "market" should read -- the market --.
Line 33, "environment" should read -- environmental --.

Column 7
Line 48, "are" should read -- be --.

Column 9
Line 61, "fractuation" should read -- fluctuation --.

Column 16
Line 65, "deice" should read -- device --.

Column 18
Line 23, "temperature" should read -- temperatures --.
Line 34, "are measured" should be deleted.
Line 37, "take" should read -- taken --.

Column 19
Line 48, "a solve" should read -- to dissolve --.

Column 22
Line 41, "was" should read -- were --.
Line 48, "particles" should read -- particle --;

UNITED STATES PATENT AND TRADEMARK OFFICE

CERTIFICATE OF CORRECTION

PATENT NO. : 6,022,659
DATED : February 8, 2000
INVENTOR(S) : Makoto Kanbayashi, et al.

It is certified that error appears in the above-identified patent and that said Letters Patent is hereby corrected as shown below:

Column 23
Line 17, "a" (second occurrence) should read -- an --.
Line 29, "same" should read -- the same --.
Line 45, "mach" should read -- match --.

Column 24
Line 64, "exhibit" should read -- exhibited --.

Column 25
Line 43, "problem" should read -- problems --.

Column 26
Line 22, "to" should read -- so --.

Column 27
Line 27, "image was" should be -- image were --
Line 31, "the" should be deleted.
Line 45, "two" should read -- low --.

Column 28
Line 37, delete "and evaluated".

Column 29
Table 3, "Ex. 1" should read
Example or Comparative Example
-- _____ --
Ex. 1

Column 30
Line 47, "sufficiently and" should read -- sufficiently blended and --.
Line 56, "Dav" should read -- (Dav --; and "was" should read -- were --.
Line 64, "particles" should read -- particle --.

UNITED STATES PATENT AND TRADEMARK OFFICE

CERTIFICATE OF CORRECTION

PATENT NO. : 6,022,659
DATED : February 8, 2000
INVENTOR(S) : Makoto Kanbayashi, et al.

It is certified that error appears in the above-identified patent and that said Letters Patent is hereby corrected as shown below:

Column 31
Line 23, "a" (second occurrence) should read -- an --.
Line 34, "were" should read -- were found --.
Line 48, "two- compound" should read -- two-component --.
Line 51, "mach" should read -- match --.
Line 53, "cyan" should read -- cyan toner --.

Column 32
Line 10, "of" should be deleted.
Line 24, "but" should be deleted.
Line 60, "are" should read -- and --.

Column 33
Line 29, delete "during the continuous image formation".

Column 35
Table 6, "um" (all occurrences) should read -- μm --.
Table 7, "Ex. 1" should read

| Example or Comparative Example |
|---|
| Ex. 1 |

Column 38
Line 3, "molecular" should read -- molecular weight --.

Signed and Sealed this

Twenty-fifth Day of September, 2001

*Attest:*

Nicholas P. Godici

*Attesting Officer*

NICHOLAS P. GODICI
*Acting Director of the United States Patent and Trademark Office*